US011589184B1

(12) United States Patent
Mont-Reynaud

(10) Patent No.: US 11,589,184 B1
(45) Date of Patent: Feb. 21, 2023

(54) DIFFERENTIAL SPATIAL RENDERING OF AUDIO SOURCES

(71) Applicant: SoundHound, Inc., Santa Clara, CA (US)

(72) Inventor: Bernard Mont-Reynaud, Santa Clara, CA (US)

(73) Assignee: SoundHound, Inc, Santa Clara, CA (US)

( * ) Notice: Subject to any disclaimer, the term of this patent is extended or adjusted under 35 U.S.C. 154(b) by 0 days.

(21) Appl. No.: 17/655,650

(22) Filed: Mar. 21, 2022

(51) Int. Cl.
*H04S 7/00* (2006.01)

(52) U.S. Cl.
CPC ..... *H04S 7/305* (2013.01); *H04S 7/40* (2013.01); *H04S 2400/01* (2013.01); *H04S 2400/11* (2013.01); *H04S 2420/01* (2013.01)

(58) Field of Classification Search
CPC ..... G10L 19/008; H04S 2420/01; H04S 2420/03; H04S 7/305; H04S 7/30; H04S 2400/11
USPC ..... 381/310, 306, 22, 23, 63
See application file for complete search history.

(56) References Cited

U.S. PATENT DOCUMENTS

| | | | | |
|---|---|---|---|---|
| 9,197,977 | B2 | 11/2015 | Mahabub et al. | |
| 2014/0064494 | A1 | 3/2014 | Mahabub et al. | |
| 2014/0161268 | A1* | 6/2014 | Antani | H04S 7/305 381/63 |
| 2017/0332186 | A1* | 11/2017 | Riggs | H04S 7/304 |
| 2020/0374645 | A1* | 11/2020 | Settel | G06F 3/16 |
| 2021/0329381 | A1* | 10/2021 | Holman | G10L 21/0216 |

OTHER PUBLICATIONS

Derksen, Milou, Spatial Audio: The Continuing Evolution, Abbey Road Institute Amsterdam, May 27, 2019.
New features available with macOS Monterey, Apple.

* cited by examiner

*Primary Examiner* — Alexander Krzystan
(74) *Attorney, Agent, or Firm* — Platinum Intellectual Property

(57) ABSTRACT

Methods and systems for intuitive spatial audio rendering with improved intelligibility are disclosed. By establishing a virtual association between an audio source and a location in the listener's virtual audio space, a spatial audio rendering system can generate spatial audio signals that create a natural and immersive audio field for a listener. The system can receive the virtual location of the source as a parameter and map the source audio signal to a source-specific multi-channel audio signal. In addition, the spatial audio rendering system can be interactive and dynamically modify the rendering of the spatial audio in response to a user's active control or tracked movement.

22 Claims, 15 Drawing Sheets

DIFFERENTIAL SPATIAL RENDERING OF AUDIO SOURCES

TECHNICAL FIELD

The present subject matter is in the field of computer multi-media user interface technologies. More particularly, embodiments of the present subject matter relate to methods and systems for rendering spatial audio.

SUMMARY OF THE INVENTION

Spatial audio is important for music, entertainment, gaming, virtual reality, augmented reality, and other multimedia applications where it delivers a natural, perceptually based experience to the listener. In these applications, complex auditory scenes with multiple audio sources result in the blending of many sounds, and the listener greatly benefits from the perception of source's location information to distinguish and identify active sound sources. The perception of space helps to separate sources in an auditory scene, both for greater realism and for improved intelligibility.

The lack of perception of an auditory space can make the scene sound unclear, confusing, or unnatural, and lose intelligibility. This is the current situation in the fast-growing teleconference field, which has failed to tap the full potential of spatial audio. For example, in an online gathering such as a virtual meeting, a listener can be easily confused about the identity of the active speaker. When several speakers talk at the same time, it is difficult to understand their speech. Even when a speaker talks individually, it is difficult to discern who is the actual speaker because the listener cannot easily read the speaker's lips. The blending of sounds without spatial information leads to low audio intelligibility for the listener. In addition, the resulting lack of a general perception of space gives the listener a poor impression of the scene and its realism. These problems make the human-computer interface unnatural and ineffective.

Placing sources in separate locations strongly improves intelligibility. If the voices of individual speakers are placed in consistent locations over time, the identification of sources will also be facilitated. Perceiving the spatial position of sources, be that their direction, distance, or both, helps to separate, understand, and identify them. When sources are visible, this is particularly true when visual placement cues are consistent with audio placement cues and thus reinforce them.

The following specification describes many aspects of using spatial audio rendering that can improve a human-computer interface and make it more intuitive and effective. Some examples are methods of process steps or systems of machine components for rendering spatialized audio fields with improved intelligibility. These can be implemented with computers that execute software instructions stored on non-transitory computer-readable media.

The present subject matter describes improved user experiences resulting from rendering sources with spatial audio to increase the perceived realism and intelligibility of the auditory scene. The system can render each virtual audio source in a specific location in a listener's virtual audio space. Furthermore, the destination devices used by different listeners may rely on different virtual audio spaces, and specific sources may be rendered in specific locations in each specific destination device. The rendering can take the source location of the source in the destination device's virtual space as a parameter and map the audio signal from the source to a source-specific multi-channel audio signal. Hence, the same audio source can be associated with different virtual locations in the virtual spaces of two or more listeners.

To implement the methods of the present subject matter, a system can utilize various sensors, user interfaces or other techniques to associate a destination with a source location. To create the spatial association between a source and a location in a virtual space, the system can adopt various audio spatialization filters to generate location cues such as Interaural Time Difference (ITD), Interaural Loudness Difference (ILD), reverberation ("reverb"), and Head-related Transfer Functions (HRTFs). The system renders the source audio into an individualized spatial audio field for each listener's device. Furthermore, the system can dynamically modify the rendering of the spatial audio in response to a change of the spatial association of the source. Such a change can be performed under user's control, which makes the human-computer interaction bilateral and interactive. In addition, the change can also be triggered by the relative movement of associated objects.

As such, the system can render natural and immersive spatial audio impressions for a human-computer interface. It can deliver more intelligible sound from the audio source and enhance the user's realistic perception of sound as to the audio source's location. This way, the present subject matter can improve the accuracy and effectiveness of a media interface between a user and a computer, particularly in its interactive form.

A computer implementation of the present subject matter comprises a computer-implemented method of rendering sources, the method comprising for each destination device of a plurality of destination devices, each destination device having a virtual space: receiving a plurality of audio signals from a plurality of sources, generating an association between each source in the plurality of sources and a virtual location in the destination device's virtual space, rendering the audio signal from each source, wherein the rendering takes the virtual location of the source in the destination device's virtual space as a parameter and maps the audio signal from the source to a source-specific multi-channel audio signal according to the parameter, mixing the source-specific multi-channel audio signal from each source into a multi-channel audio mix for the destination device, and sending the multi-channel audio mix to the destination device.

According to some embodiments, a first source from the plurality of sources is associated with a first virtual location in a first destination device's virtual space, and the first source from the plurality of sources is associated with a second virtual location in a second destination device's virtual space. Furthermore, the first virtual location can be different from the second virtual location.

According to some embodiments, the spatial audio rendering system further comprises a first destination device with a user interface, wherein the user interface allows a user to select a first source in the plurality of sources and a first virtual location in a first destination device's virtual space to express a location control indication. The first destination device can send a location control request to a processor indicating the first source in the plurality of sources and the first virtual location in the device's virtual space. A processor of the spatial audio rendering system can modify the association of the virtual location of the first source for the first destination device according to the location control indication.

According to some embodiments, the rendering to a source-specific multi-channel audio signal can include one or more auditory cues regarding the location of the source in the destination device's virtual space. According to some embodiments, the system can compute a first delay for a first channel of the source-specific multi-channel audio signal according to the virtual location of the source, and compute a second delay for a second channel the source-specific multi-channel audio signal according to the virtual location of the source.

According to some embodiments, the system can compute a first loudness for a first channel of the source-specific multi-channel audio signal according to the virtual location of the source, and compute a second loudness for a second channel of the source-specific multi-channel audio signal according to the virtual location of the source.

According to some embodiments, the system can compute a first reverb signal of the source, and compute a mix of the first reverb signal of the source and a direct signal of the source according to the virtual location of the source.

According to some embodiments, the spatial audio rendering system can receive location data of each source in the destination device's virtual space from one or more sensors. According to some embodiments, the spatial audio rendering system can receive a user's control over the virtual location of the source in the destination device's virtual space, and the system can adjust the rendering of the source based on the user's control.

According to some embodiments, the spatial audio rendering system can receive a change signal for the association between each source in the plurality of sources and the virtual location in the destination device's virtual space, and the system can adjust the rendering of the source based on the change signal.

According to some embodiments, the spatial audio rendering system can generate one or more visual cues in association with the source location, the one or more visual cues being consistent with one or more auditory cues.

Another computer implementation of the present subject matter comprises a computer-implemented method of rendering a source for each destination of a plurality of destinations, each destination having a virtual space, the method comprising: receiving a first input audio signal from the source, generating an association based on a source placement between the source and a virtual location in the destination's virtual space, the virtual location differing from the virtual location of the same source in the space of a different destination, rendering the first input audio signal from the source according to the virtual location of the source in the destination's virtual space to produce a first multi-channel audio signal, and sending an output signal comprising the first multi-channel audio signal to the destination.

According to some embodiments, the spatial audio rendering system can compute a first delay for a first channel of the first multi-channel audio signal according to the virtual location of the source from a reference angle, and the system can compute a second delay for a second channel of the first multi-channel audio signal according to the virtual location of the source from the reference angle.

According to some embodiments, the spatial audio rendering system can compute a first loudness for a first channel of the first multi-channel audio signal according to the virtual location of the source, and the system can compute a second loudness for a second channel of the first multi-channel audio signal according to the virtual location of the source.

According to some embodiments, the spatial audio rendering system can further create a distance cue by computing a first reverb signal of the source, and computing a mix of the first reverb signal of the source and a direct signal of the source according to the virtual location of the source.

According to some embodiments, the spatial audio rendering system can create a three-dimensional cue by computing a first Head-Related Transfer Function for a first channel of the first multi-channel audio signal according to the virtual location of the source, and computing a second Head-Related Transfer Function for a second channel of the first multi-channel audio signal according to the virtual location of the source.

According to some embodiments, the spatial audio rendering system can further receive a second input audio signal from a second source, generate an association based on a source placement between the second source and a second virtual location in the destination's virtual space, render the second input audio signal from the second source according to the second virtual location of the second source in the destination's virtual space to produce a second multi-channel audio signal, and mix the first multi-channel audio signal and the second multi-channel audio signal to create the output signal.

According to some embodiments, the spatial audio rendering system can receive a user's control for the association between the source and the virtual location in the destination's virtual space. According to some embodiments, the spatial audio rendering system can receive a change signal, and change the association according to the change signal.

Another computer implementation of the present subject matter comprises a computer-implemented method, comprising: receiving an identification of a source in a plurality of sources, each source being associated with an audio signal, receiving an identification of a virtual location in a virtual space, sending a location control message to a server to request that the audio signal associated with the source be rendered in the virtual location in the virtual space, and receiving audio from the server, the audio being rendered according to the identification of the virtual location.

According to some embodiments, the virtual location is based on spatial data indicating a virtual audio source's location within a destination device's virtual space, and the location control message comprises spatial data collected by one or more sensors.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter is illustrated by way of example, and not by way of limitation, in the figures of the accompanying drawings in which.

DETAILED DESCRIPTION

The present subject matter pertains to improved approaches for a spatial audio rendering system. Embodiments of the present subject matter are discussed below with reference to FIGS. 1-14.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

The following sections describe systems of process steps and systems of machine components for generating spatial audio scenes and their applications. These can be implemented with computers that execute software instructions stored on non-transitory computer-readable media. An improved spatial audio rendering system can have one or more of the features described below.

Figure 1:
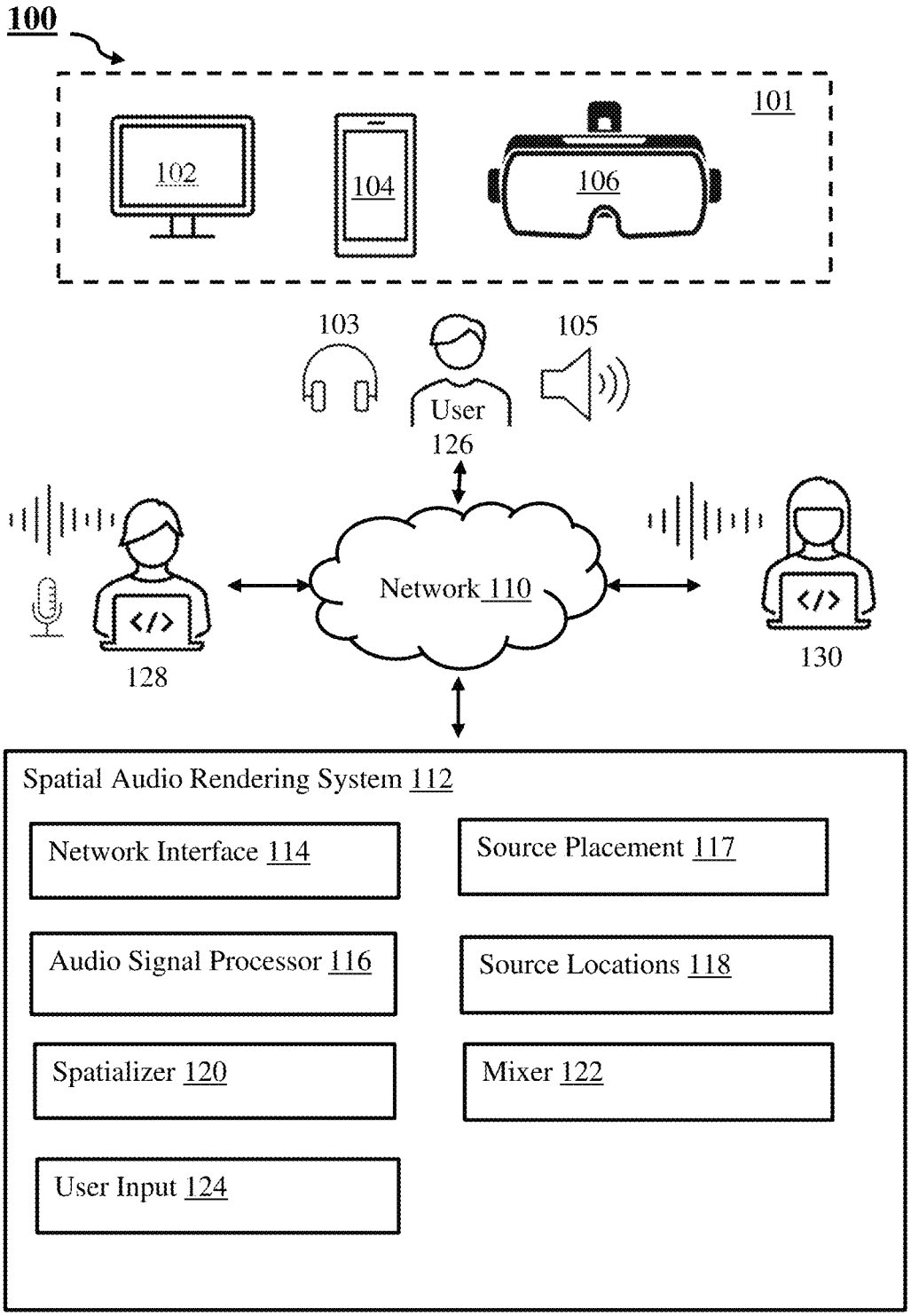
FIG. 1 shows an exemplary diagram of a spatial audio rendering system for rendering spatialized audio fields, according to one or more embodiments of the present subject matter.

FIG. 1 shows an exemplary diagram 100 of a spatial audio rendering system 112 for rendering spatialized audio-visual fields or scenes. Traditionally, when user 126 listens to speaker 128 and/or speaker 130 through destination device 101, audio data from different speakers can result in the blending of sounds, which not only leads to a loss of audio location but also makes it difficult to understand. Spatial audio rendering system 112 can utilize various spatialization techniques to compute multi-channel audio output that creates in the listener perception of a spatial location for each sound source.

According to some embodiments, spatial audio rendering system 112 can comprise, for example, network interface 114, audio signal processor 116, spatializer 120, source placement 117, source locations 118, spatializer 120, mixer 122, and user input 124. Network interface 114 can comprise a communications interface and implementations of one or more communications protocols (e.g., in a multi-layer communications stack). The network interface 114 is configured to receive audio data from speaker 128 and speaker 130 via network 110. According to some embodiments, the network interface 114 may comprise a wired or wireless physical interface and one or more communications protocols that provide methods for receiving audio data in a predefined format.

According to some embodiments, network 110 can comprise a single network or a combination of multiple networks, such as the Internet or intranets, wireless cellular networks, local area network (LAN), wide area network (WAN), WiFi, Bluetooth, near-field communication (NFC), etc. Network 110 can comprise a mixture of private and public networks, or one or more local area networks (LANs) and wide-area networks (WANs) that may be implemented by various technologies and standards.

According to some embodiments, spatializer 120 can delay an output channel relative to another, in order to create a time difference between the signals received by the two ears of a listener, contributing to a sense of azimuth (direction) of the source. This is called the Interaural Time Difference (ITD) cue for azimuth. According to some embodiments, spatializer 120 can attenuate an output channel relative to another, in order to create a loudness difference between the signals received by the two ears of a listener, contributing to a sense of azimuth (direction) of the source. This is called the Interaural Loudness Difference (ILD) cue for azimuth. According to some embodiments, the ILD cue is applied in a frequency-dependent manner. According to some embodiments, spatializer 120 can apply a FIR (Finite Impulse Response) or IIR (Infinite Impulse Response) filter to the source signal, in order to create reverberation (reverb) which contributes to a sense of envelopment and can increase the natural quality of the sound. Reverb can be applied to a mono source signal, which is then spatialized using ITD or ILD or both. According to some embodiments, spatializer 120 uses separate reverberation filters for different output channels. According to some embodiments of reverberation, a parameter of spatializer 120 can control the relative loudness of the original signal, i.e., direct signal, and the delayed signals, i.e., reflections or 'reverb', to contribute to a sense of proximity (distance) of the source. The closer the source is, the louder it is relative to the reverb, and conversely.

Spatial audio rendering system 112 can be implemented by various devices or services to simulate realistic spatial audio scenes for user 126 via network 110. For example, operations or components of the system can be implemented by a spatial audio rendering provider or server in network 110 through a web API. According to some embodiments, some functions or components of the system can be implemented by one or more local computing devices. According to some embodiments, a hybrid of the remote devices and local devices can be utilized by the system.

According to some embodiments, audio signal processor 116 can comprise any combination of programmable data processing components and data storage units necessary for implementing the operations of spatial audio rendering system 112. For example, audio signal processor 116 can be a general-purpose processor, a specific purpose processor such as an application-specific integrated circuit (ASIC), a field-programmable gate array (FPGA), a graphics processing unit (GPU), a digital signal processor (DSP), a set of logic structures such as filters and arithmetic logic units, or any combination of the above.

It should be noted that instead of being located in a remote server device, some functions or components of audio signal processor 116 may alternatively be implemented within the computing devices receiving the initial audio data or the destination devices receiving the rendered spatial audio-visual fields. Different implementations may differently split local and remote processing functions.

According to some embodiments, via network interface 114, spatial audio rendering system 112 can receive a number of signals from a group of audio sources, e.g., from audio capture devices associated with speaker 128 and/or speaker 130. The audio capture devices may comprise one or more microphones configured to capture respective audio sound waves and generate digital audio data. In some embodiments, captured digital audio data is encoded for transmission and storage in a compressed format.

According to some embodiments, source placement 117 can be a model or unit configured to define or map the association of source locations 118, which comprises the association or a mapping matrix representing location relationships in the destination's virtual space. According to some embodiments, source placement 117 can define a virtual audio source's location within a destination device's virtual space. The resulting source layout is stored in source locations 118. According to some embodiments, source placement 117 can generate a default layout based on, for example, available spatial data and other information. According to some embodiments, the source placement 117 can generate a default layout that arranges the sources in a configuration—generally coordinated with their position on the screen. This default layout will be used by every destination. For spatial audio and visual data, the listeners (i.e., the users of destination devices) are given user interfaces to override these defaults with custom choices. Other alternatives or "presets" can also be implemented, for example, via user preferences. An example of a preset is a "conference panel" preset that allows known "panelists" (or source speakers interactively designated by a user) to be placed in a row or arc or semi-circle, left to right, so that they are distinguished by azimuth and not by distance.

According to some embodiments, spatial audio rendering system 112 can receive spatial data from one or more sensors, user interfaces or other techniques. The sensors can be any visual or imaging devices configured to provide relative spatial data, e.g., azimuth angles, elevation angles, the distance between a virtual audio source's location and the user's location. For example, the sensors can be one or more stereoscopic cameras, 3D Time-of-Flight cameras, and/or infrared depth-sensing cameras. According to some embodiments, source locations 118 can further be based on spatial data such as the objects and room geometry data for the reverberation cues in a virtual space.

According to some embodiments, spatial data can further comprise head and/or torso movement data of user 126, which can be collected via a low-latency head tracking system. For example, accelerometers and gyroscopes embedded in headphones 103 can continuously track the user's head movement and orientation. In addition, other computer vision techniques can be utilized to generate spatial data, including the head and/or torso movement data.

According to some embodiments, upon receiving the spatial data, spatial audio rendering system 112 can generate, via source placement 117, source locations 118 between each source and a virtual location within a virtual space. The source locations can comprise spatial parameters indicating the spatial relationship between the audio source and the user's ears. For example, source locations 118 can comprise the source-ear acoustic path. Furthermore, source locations 118 can further comprise the object/wall location data surrounding the user.

According to some embodiments, spatial audio rendering system 112 can become interactive by allowing user input 124 to modify source locations 118, resulting in a dynamic adjustment of the spatial audio-visual fields. According to some embodiments, user input 124 can be a discrete location control request, i.e., a change signal explicitly entered by user 126 via an interface. For example, a user could select a preferred location on a screen for a specific source. According to some embodiments, users can use voice queries to modify the source locations. According to some embodiments, user input 124 can modify a microphone location within the virtual space.

According to some embodiments, user input 124 can be a continuously tracked movement, such as the movement of a cursor or the movement of a part of the body. In addition, the virtual audio source's relative movement in the virtual space can lead to the modification of source locations 118.

According to some embodiments, via spatializer 120, spatial audio rendering system 112 can render the spatialized audio-visual fields based on source locations 118. The system can take the association as parameters for auditory models to generate a source-specific multi-channel audio signal. Furthermore, spatializer 120 can adopt various auditory models and generate various auditory cues, such as ITD, ILD, reverberation, HRTFs. According to some embodiments, spatializer 120 can comprise one or more acoustic filters to convolve the original audio signal with the auditory cues.

According to some embodiments, mixer 122 can mix the source-specific multi-channel audio signal from each audio source into a multi-channel audio mix for destination device 101. A transmitter can send the multi-channel audio mix to destination device 101. Audio playback devices of destination device 101, e.g., headphones or loudspeakers, can render the spatialized audio-visual field for user 126, and for each user in a group of users.

According to some embodiments, user 126 can receive the rendered audio-visual fields via destination device 101. Examples of destination device 101 can be, for example, a personal computing device 102, a mobile device 104, a head-mount augmented reality (AR) device 106. Destination device 101 can have one or more embedded or external audio playback devices, such as headphones 103 and loudspeakers 105. According to some embodiments, destination device 101 can further comprise one or more embedded or external visual displays, such as a screen. These displays can deliver corresponding visual cues in association with the auditory scenes. This way, user 126 can experience immersive virtual scenes similar to his/her perception of real-world interactions, meaning what you hear matches what you see.

According to some embodiments, user 126 can be one of several users that can simultaneously receive individualized spatial audio-visual fields that are different from each other. For example, a first audio source of speaker 128 can be associated by a first destination device with a first virtual location in the first destination device's virtual space. At the same time, the first audio source of speaker 128 can be associated by a second destination device with a second virtual location in the second device's virtual space. As the first virtual location differs from the second virtual location, the individualized spatial audio-visual fields for the first and the second destination device are different. Furthermore, different users of the first and the second destination devices can independently modify the source locations of speaker 128 in its respective virtual space.

Figure 2A:
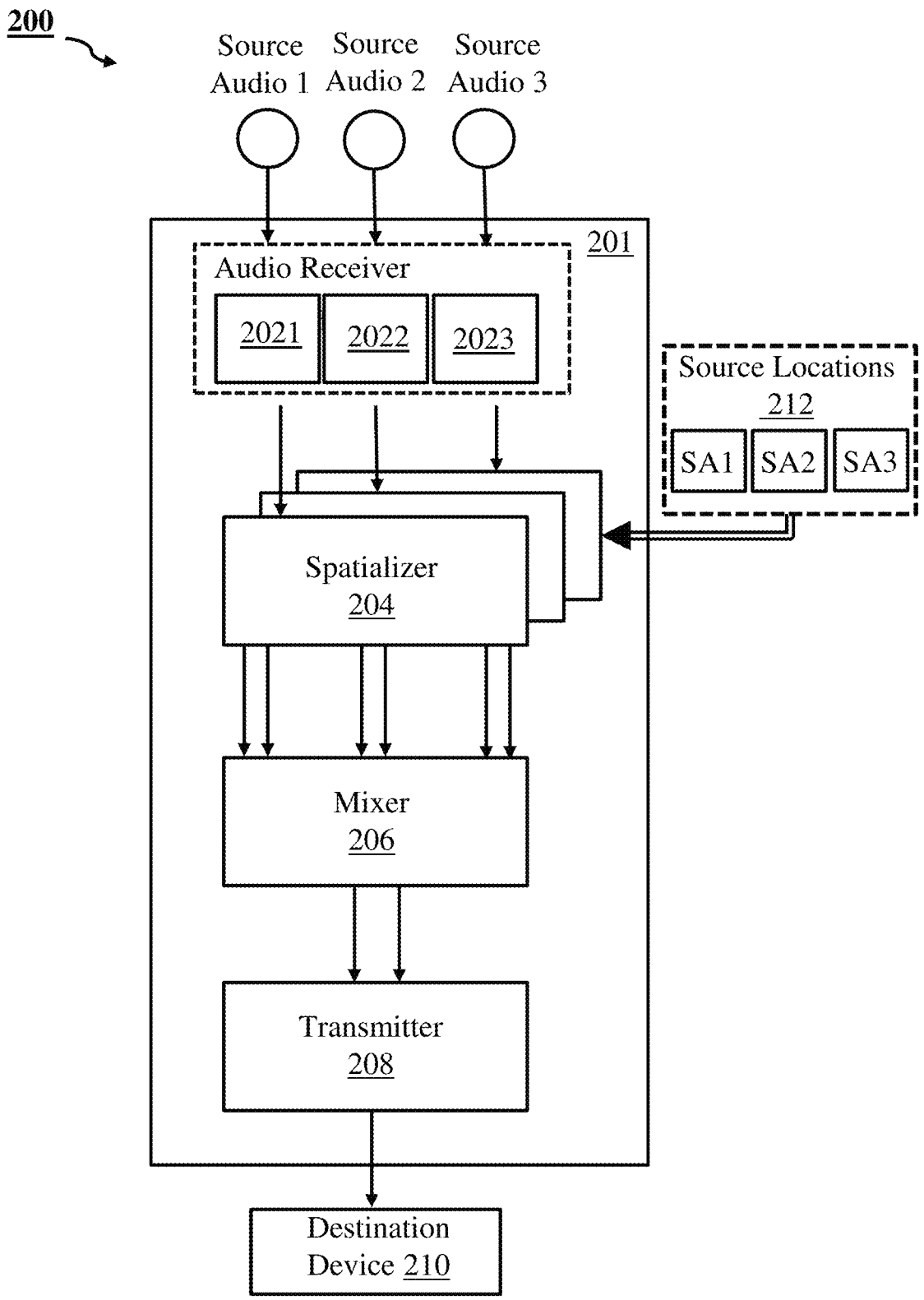
FIG. 2A shows an exemplary process of rendering spatialized audio fields from a plurality of source audios for a destination device, according to one or more embodiments of the present subject matter.

FIG. 2A shows an exemplary process 200 of rendering spatialized audio fields from a plurality of source audios for a destination device. According to some embodiments, via respective audio receivers 2021, 2022 and 2023, spatial audio rendering system 201 can receive audio signals from a number of sources source audio 1, source audio 2, and source audio 3 in this example. For each source, spatial audio rendering system 201 can generate respective source locations 212 between each audio source and a location within a virtual space, e.g., SA1, SA2 and SA3. Such source locations 212 can be based on spatial data indicating the virtual audio source's location within a destination device's virtual space or based on a user's selection.

According to some embodiments, each audio signal from a source audio can be subject to a respective spatializer 204. Each spatializer can generate individualized spatialization cues for each audio signal. The spatialization can take the association of the source in the virtual space as a parameter and map the audio signal from the source to a source-specific multi-channel audio signal. Furthermore, spatializer 204 can generate a number of auditory cues, such as ITD, ILD, reverberation, HRTFs, to locate the virtual audio source for each user.

As an auditory cue, ITD is the time interval between when a sound enters one ear and the other. It is caused by the separation of the two ears in space and the sound's traveling path length difference. For example, a sound located at the left-front side of a user reaches his/her left ear before it enters the right ear. Similarly, ILD manifests as a difference in loudness between the two ears. For example, the sound located at the left-front side of a user reaches his/her left ear at a higher loudness level than the right ear. This is not only due to a greater distance, but to the "shadowing" effect that occurs when a sound wave travels around the head. When shadowing is modeled accurately, the ILD effect also applies a frequency filter to the audio signal that travels around the head.

Furthermore, the system can adopt reverberation cues to render the perceived source location. Reverberation is created when a direct audio signal is reflected by other object's surface in the space, creating reverberated and delayed audio signals. Various reverberation techniques or algorithms can be utilized to render artificial reverberation cues. According to some embodiments, a Finite Impulse Response (FIR) or Infinite Impulse Response (IIR) filter can generate the reverberation cues. For example, a source feels closer when the direct audio signal is much louder than the reverberation signal. By contrast, a source feels distant when the reverberation signal is louder than the direct audio signal.

HRFTs is a filter defined in the spatial frequency domain that describes sound propagation from a specific point to the listener's ear. A pair of HRTFs for two ears can include other auditory cues, such as the ITD, ILD, reverberation cues. HRTFs can characterize how the ear receives a sound from a point in space. Via HRTFs, the sound can be rendered based on the anatomy of the user, such as the size and shape of the head, geometry of the ear canals, etc. According to some embodiments, an individualized or user-specific HTRF can be adopted when time and resources are available. According to some embodiments, one or more open-source, non-individualized HTRF databases can be used to provide general and approximate auditory cues.

According to some embodiments, a number of audio signals can be simultaneously transformed into a number of source-specific multi-channel audio signals by multiple spatializers 204. In other words, the system can simulate several virtual audio sources at different positions in parallel. The audio stream of each source audio can be convolved with its corresponding auditory cues or filters, e.g., ITD, ILD, reverberations, etc.

According to some embodiments, mixer 206 can mix the source-specific multi-channel audio signals into a multi-channel audio mix for a destination device. Transmitter 208 can send the multi-channel audio mix to destination device 210 for spatial audio playback.

Figure 2B:
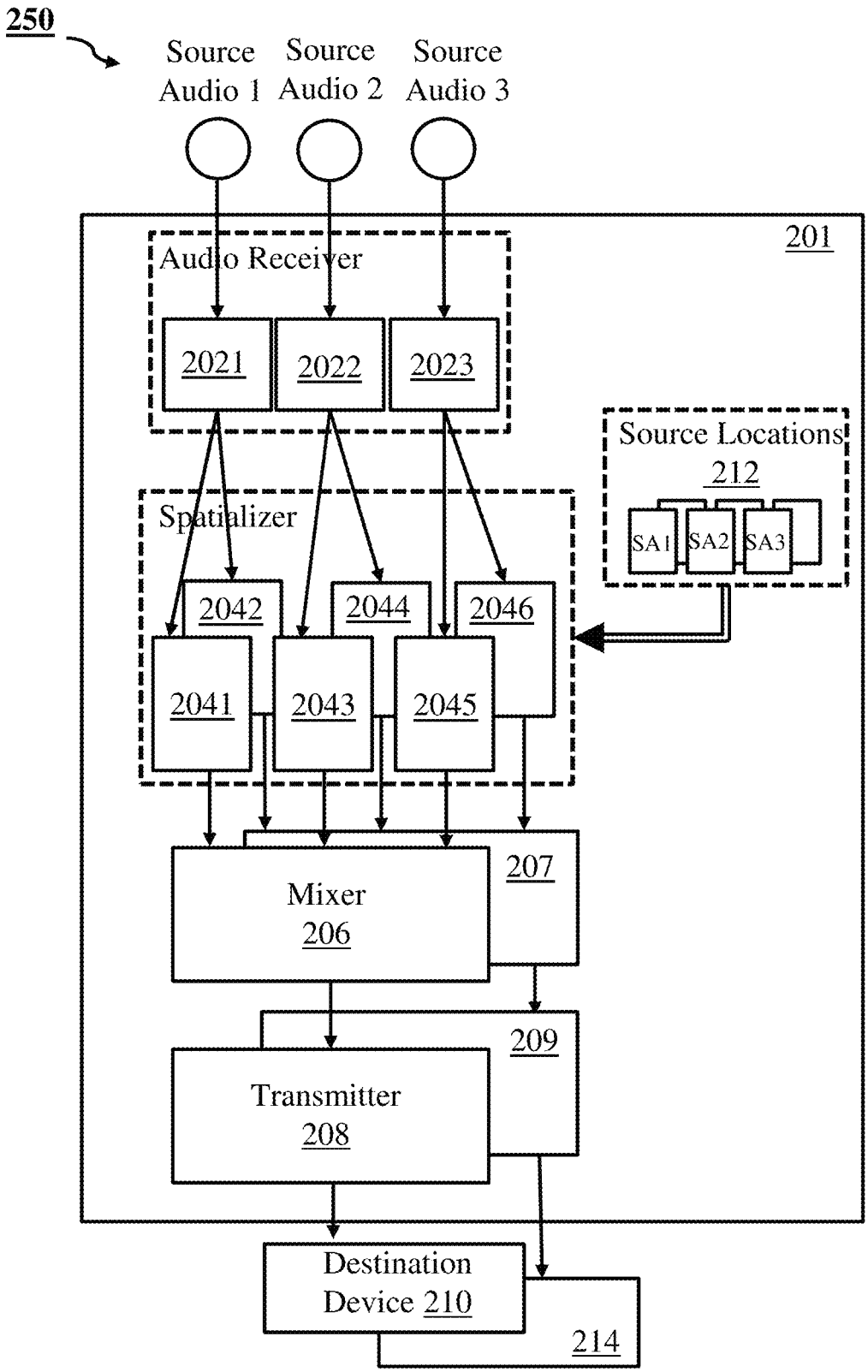
FIG. 2B shows another exemplary process of rendering spatialized audio fields from a plurality of source audios for more than one destination device, according to one or more embodiments of the present subject matter.

FIG. 2B shows another exemplary process 250 of rendering spatialized audio fields from a plurality of source audios for destination devices 210 and 214. According to some embodiments, via respective audio receivers 2021, 2022 and 2023, spatial audio rendering system 201 can receive audio signals from a number of sources source audio 1, source audio 2, and source audio 3 in this example. For each source audio, spatial audio rendering system 201 can generate respective source locations 212, e.g., SA1, SA2 and SA3, between each audio source and a location within a virtual space for destination device 210 and 214. Such source locations 212 can be based on spatial data indicating the virtual audio source's location within a destination device's virtual space or based on a user's selection.

According to some embodiments, each audio signal from a source audio can be subject to a respective spatializer, e.g., 2041, 2042, 2043, 2044, 2045 and 2046. Each spatializer can generate individualized spatialization cues for each audio signal. The spatialization can take the source locations of the source in the virtual space as a parameter and map the audio signal from the source to a source-specific multi-channel audio signal. Furthermore, spatializers 2041, 2042, 2043, 2044, 2045 and 2046 can generate a number of auditory cues, such as ITD, ILD, reverberation, HRTFs, to locate the virtual audio source for each user.

According to some embodiments, a spatializer, e.g., 2041, can delay an output channel relative to another, in order to create a time difference between the signals received by the two ears of a listener, contributing to a sense of azimuth (direction) of the source. This is called the Interaural Time Difference (ITD) cue for azimuth. According to some embodiments, the spatializer can attenuate an output channel relative to another, in order to create a loudness difference between the signals received by the two ears of a listener, contributing to a sense of azimuth (direction) of the source. This is called the Interaural Loudness Difference (ILD) cue for azimuth. According to some embodiments, the ILD cue is applied in a frequency-dependent manner. According to some embodiments, the spatializer 120 can apply a FIR (Finite Impulse Response) or IIR (Infinite Impulse Response) filter to the source signal, in order to create reverberation (reverb) which contributes to a sense of envelopment and can increase the natural quality of the sound. Reverb can be applied to a mono source signal, which is then spatialized using ITD or ILD or both. According to some embodiments, the spatializer 120 uses separate reverberation filters for different output channels. According to some embodiments of reverberation, a parameter of the spatializer can control the relative loudness of the original signal, i.e., direct signal, and the delayed signals, i.e., reflections or 'reverb', to contribute to a sense of proximity (distance) of the source. The closer the source is, the louder it is relative to the reverb, and conversely.

According to some embodiments, mixer 206 can mix the source-specific multi-channel audio signals into a multi-channel audio mix for destination device 210, whereas mixer 207 can mix the source-specific multi-channel audio signals into a multi-channel audio mix for destination device 214. Transmitter 208 can send the multi-channel audio mix to destination device 210 for spatial audio playback, and transmitter 209 can send the multi-channel audio mix to destination device 214 for spatial audio playback.

As such, a number of audio signals can be simultaneously transformed into a number of source-specific multi-channel audio signals by multiple spatializers. In other words, the system can simulate several individualized virtual audio sources at different positions in parallel. The audio stream of each source audio can be convolved with its corresponding auditory cues or filters, e.g., ITD, ILD, reverberations, etc.

Figure 3:
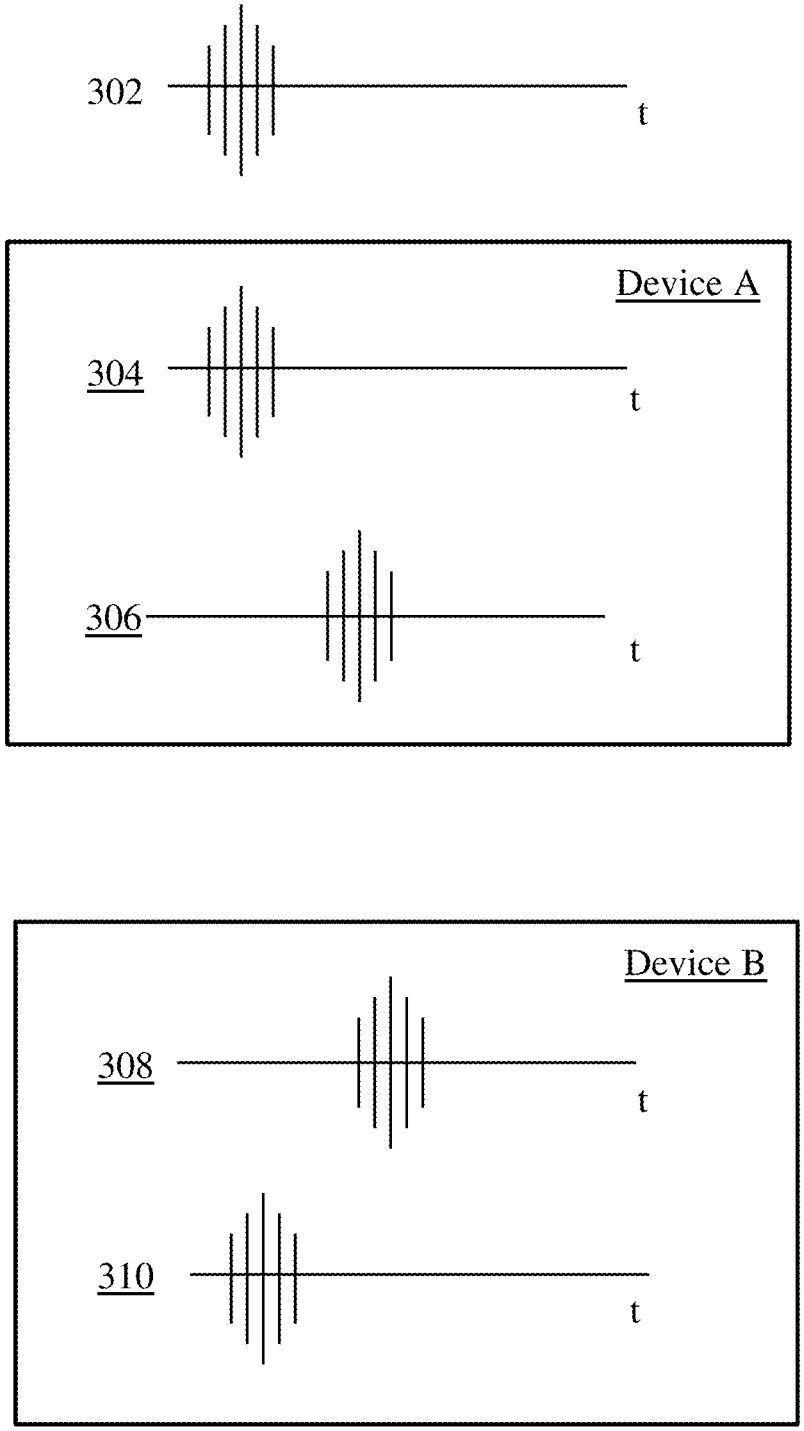
FIG. 3 shows exemplary audio signals that can be individually spatialized for different destination devices, according to one or more embodiments of the present subject matter.

FIG. 3 shows an exemplary audio signal 302 from a first source audio that can be individually spatialized for destination device A and destination device B. According to some embodiments, audio signal 302 can be a mono signal from an audio source that is received by a microphone. Each destination device A and destination B can have a respective virtual space, which can comprise a partial or full-sphere sound field surrounding a user.

In this example, for destination device A, a virtual audio source of the audio signal 302 can be shown on a display positioned at the left-front side of a user. Accordingly, ITD-based auditory cues can add time delay to direct audio signal 302 for the right channel of destination device A, resulting in a right-channel audio signal 306. According to some embodiments, the left-channel audio signal 304 can remain substantially similar to the audio signal 302. In addition, ILD-based auditory cues can also be applied. For example, the sound loudness level of left-channel audio can be higher than that of the right-channel audio.

On the other hand, for destination device B, a virtual audio source of the audio signal 302 can be shown on a display positioned at the right-front side of a user. Accordingly, an ITD-based auditory cue can add time delay to direct audio signal 302 for the left channel of destination device A, resulting in a left-channel audio signal 308. According to some embodiments, the right-channel audio signal 310 can remain substantially similar to the audio signal 302. In addition, ILD-based auditory cue can also be applied. For example, the sound loudness level of right-channel audio can be higher than that of the left-channel audio. As such, for the same source audio signal 302, the system can render individualized spatial audio signals for each destination device associated with different listeners.

Figure 4:
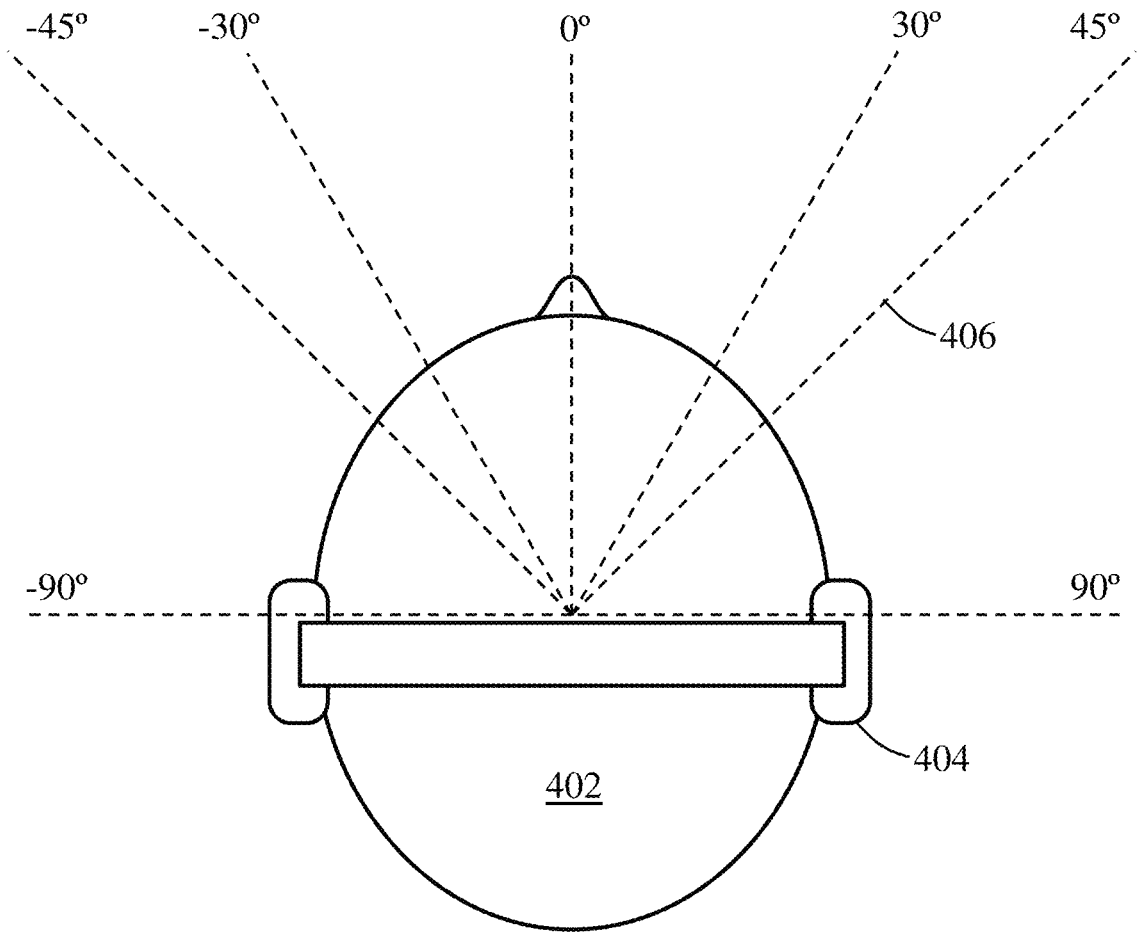
FIG. 4 shows exemplary headphones configured to render spatialized audio signals for a user, according to one or more embodiments of the present subject matter.

FIG. 4 shows exemplary headphones configured to render spatialized audio signals for a user. According to some embodiments, headphones 404 can be ideal to playback binaural sounds for the two ears. According to some embodiments, the system can convolve a mono or stereo signal with auditory cue filters to simulate the location of virtual audio source for user 402. As described herein, the system can generate a source-specific multi-channel audio signal based on the location of the source in a destination's virtual space.

As shown in FIG. 4, the azimuth range 406 of the virtual audio source rendered by headphones 404 can be between −90° and −90°. Angles of 30° and 45° are shown for reference. The full azimuth range of headphones 404 also includes positions behind the ears. In the absence of additional cues to eliminate the ambiguity, the source location from earphones is subject to an effect called front-back confusion.

Figure 5:
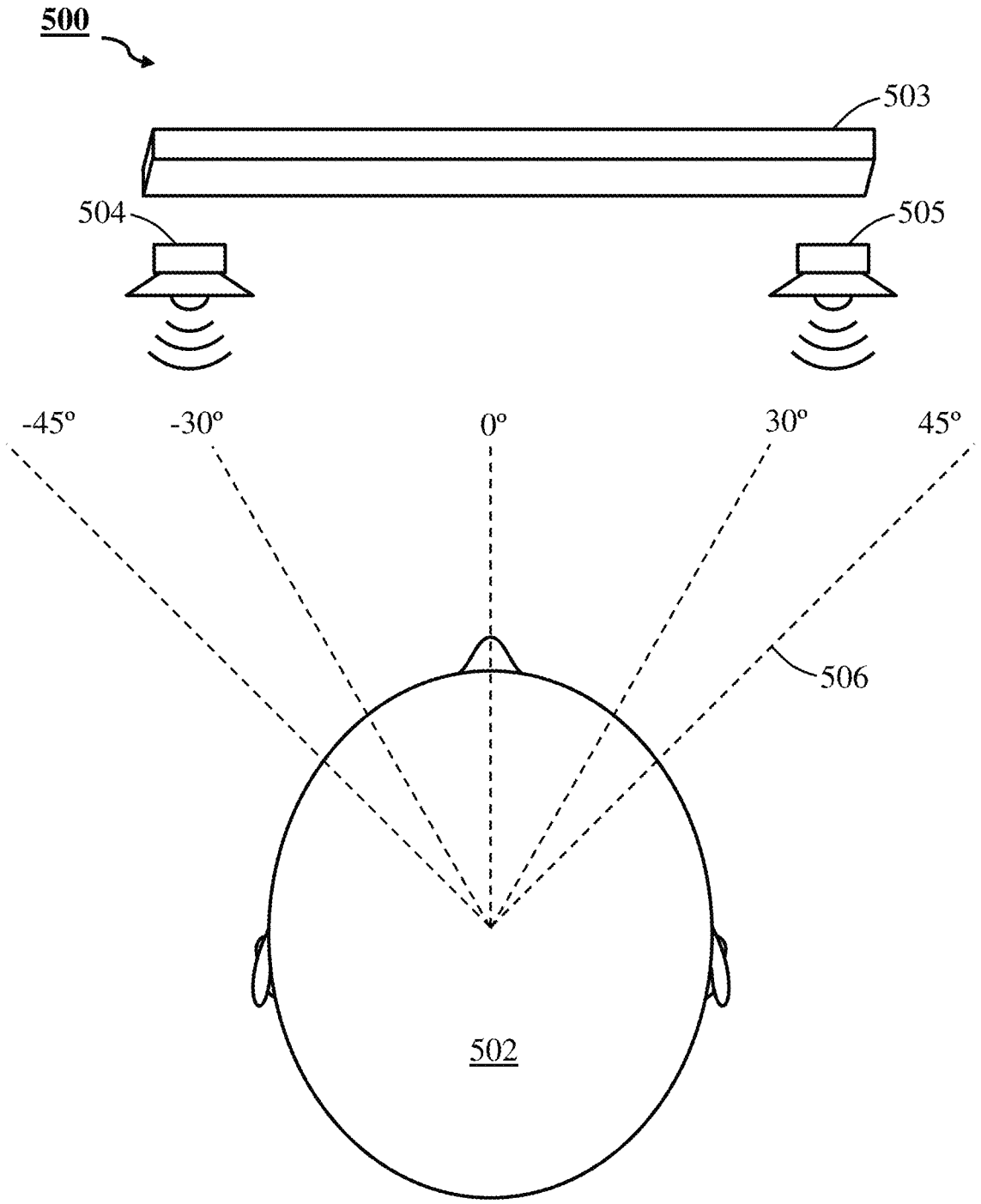
FIG. 5 shows exemplary loudspeakers configured to render spatialized audio signals for a user, according to one or more embodiments of the present subject matter.

FIG. 5 shows a device setting 500 having loudspeakers configured to render spatialized audio signals for a user 502. According to some embodiments, a multi-loudspeaker setup, e.g., left loudspeaker 504 and right loudspeaker 505 on either side of display screen 503, can reproduce binaural sound field rendering for user 502. According to some embodiments, a pre-processing crosstalk cancellation system (CCS) can be adopted to reduce the undesired crosstalk in binaural rendering by loudspeakers.

According to some embodiments, the system can convolve a mono or stereo signal with the auditory cue filters to simulate the virtual audio source for user 502. As described herein, the system can generate a source-specific multi-channel audio signal based on the source locations between the virtual audio source and user 502 in a virtual space. According to some embodiments, each channel of the audio signal can be associated with a loudspeaker. According to some embodiments, the locations of the loudspeakers can be considered when rendering the source-specific multi-channel audio signal, for example, in an object-based audio rendering system.

As shown in FIG. 5, the azimuth range 506 of the virtual audio source rendered by loudspeakers can be between −45° and 45°. According to some embodiments, the minimal azimuth resolution of loudspeakers can be approximately 30° or less. The azimuth range of the audio field rendered by a multi-speaker setup can be from 0° to 360°, depending on the number and locations of the loudspeakers.

Figure 6:
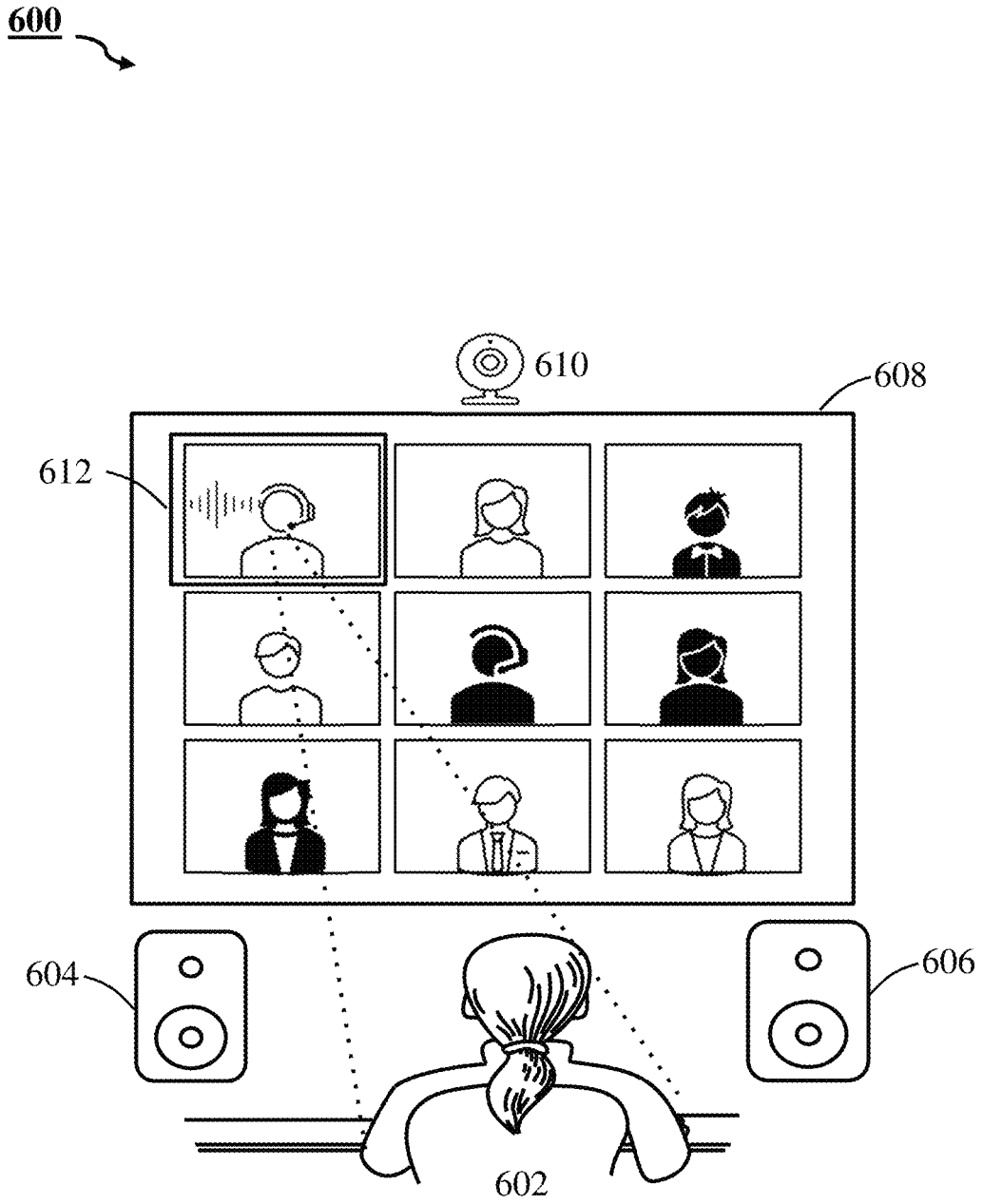
FIG. 6 shows an exemplary audio-visual field of a first user in a multi-speaker virtual conference, according to one or more embodiments of the present subject matter.

FIG. 6 shows an exemplary audio-visual field 600 of a first user in a multi-speaker virtual conference. First, user 602 can join a virtual conference via a stereo speaker setup, e.g., left loudspeaker 604 and right loudspeaker 606. As shown in FIG. 6, a computing device with a display 608 can show video streams from a number of attendees. An active speaker can be displayed at any area on display 608. In this example, the active speaker is shown near the top left corner 612 of display 608.

According to some embodiments, audio signals from each meeting attendee can be captured via respective nearby audio receivers and transmitted to corresponding audio receivers of the spatial audio rendering system. For each attendee, the signals can be represented in different audio formats, e.g., a mono or stereo signal, or other format. In this example, the spatial audio rendering system can receive a source audio signal from the active speaker located at the top left corner 612 and render it in the spatialized form to user 602, as described hereinafter.

The source placement information can indicate a virtual source location according to a number of policies. A source seen on the left on the screen can be given a virtual audio source location on the left, using ITD and ILD cues for source azimuth. If the destination device had 4 speakers, two speakers above the previous two, it would be possible to generate elevation cues as well. According to some embodiments, via one or more sensors, the system can receive and calculate spatial data indicating a virtual audio source location within a virtual space. In this example, the virtual space is a half-spherical sound field in front of first user 602. These sensors can be any imaging device that are configured to provide the approximate spatial data. Examples of the sensors can be stereoscopic cameras, 3D Time-of-Flight cameras, and/or infrared depth-sensing cameras. For example, one or more stereoscopic camera 610 can capture the location data of first user 602's head/ear in relation to the display 608. Camera 610 can further receive the objects/room geometry data of first user 602. Furthermore, the spatial data can be dynamic as the sensors can continuously track the first user 602's head/torso movements. The spatial data can also be modified by a user's control or input. In addition, various computer vision techniques can be utilized to generate the spatial data.

According to some embodiments, the spatial data can comprise the approximate azimuth range of the top left corner 612 of the display, i.e., the active speaker's head image, in relation to the head/ear of first user 602. In addition, the elevation range and distance between the virtual audio object and the user's head/ear can be received or estimated.

According to some embodiments, the spatial audio rendering system can generate source placement based on the active speaker's location as it appears on display 608, e.g., source location data. A computing device can provide the size and location of the active speaker's image on display 608 to the system by a computing device. Furthermore, this virtual location data can be the source location for the calculation of the source-ear acoustic path.

According to some embodiments, upon receiving such spatial data, the system can generate a first source locations between the virtual source's location and the first user 602's head/ear. The first source locations can comprise spatial parameters indicating the spatial relationship between the two objects.

For example, the first source locations can comprise the source-ear acoustic path. As shown in FIG. 6, the top left corner 612 in relation to first user 602's head can be categorized by a specific range of azimuth angles, e.g., 60°-90°, a range of elevation angles, e.g., 75°-85°, and an estimated distance, e.g., 2 ft-3 ft. In other words, for first user 602, the active speaker appears at his/her left-top front side.

According to some embodiments, spatial audio rendering system can render the spatialized audio-visual fields for first user 602 based on the first source locations with one or more auditory cues. The system can convolve the direct audio signal with auditory cues to generate a first source-specific multi-channel audio signal. The auditory cues can be generated by the source locations as parameters to various auditory models. According to some embodiments, a spatializer with acoustic filters can process the audio signal to generate the first source-specific audio signal.

According to some embodiments, auditory cues, such as ITD, ILD, reverberation, HRTFs, can be incorporated into the first multi-channel audio signal. According to some embodiments, as the ITD cues, the system can determine a first delay of a left channel and a second delay of a right channel of the multi-channel audio signal. In this example, due to the slight-longer acoustic path to the user's right ear, the second delay of the right channel is larger than the first delay of the left channel.

According to some embodiments, as the ILD cues, the system can compute a first loudness level for a left channel and a second loudness level of a right channel of the multi-channel audio signal. In this example, due to the closer acoustic path to the user's left ear, the first loudness level of the left channel is larger than that of the right channel.

According to some embodiments, reverberation or dissonance cues can be added to the multi-channel audio signal based on the estimated distance. Stereoscopic camera 610 can further provide a profile of the objects/walls around first user 602 for reverberation estimation. Various reverberation techniques or algorithms can be utilized to render artificial reverberation cues. According to some embodiments, a FIR filter can generate reverberation cues.

According to some embodiments, the system can determine a first reverb signal of the source signal and determine a mix of the first reverb signal and the original source signal. For example, a source feels closer when the direct audio signal is much louder than the reverberation signal. By contrast, a source feels distant when the reverberation signal is louder than the direct audio signal.

As such, when loudspeakers 604 and 606 process the first multi-channel audio signal, the playback sound is intuitively rendered as coming from the first user's left-top front side, which matches the user's live view of the active speaker. This makes the user's audio perception realistic and natural. In addition, the auditory-convolved sound can be more intelligible due to the acoustic enhancement, e.g., the sound can be louder and closer.

According to some embodiments, when there is more than one active speaker on display 608, the system can generate a respective source-specific multi-channel audio signal for each of the other active speakers. Each such source-specific audio signal can be based on its corresponding source locations such as the source-ear acoustic pathway or the user's input. Furthermore, the system can mix the several multi-channel audio signals from different speakers into a multi-channel audio mix. In addition, the system can transmit the resulting audio mix to loudspeakers 604 and 606 that can render corresponding auditory scenes to match first user 602's active speaker view.

Furthermore, according to some embodiments, display 608 can show corresponding visual cues in connection with the auditory cues. For example, a colored frame can be shown around the active speaker's image window. For another example, the speaker's image window can be enlarged or take the full display for highlighting purposes. It is further noted that when the user's input changes the virtual location or visual cues of the active source, the simultaneously rendered spatial audio scene can be automatically modified to match the user's view.

Figure 7:
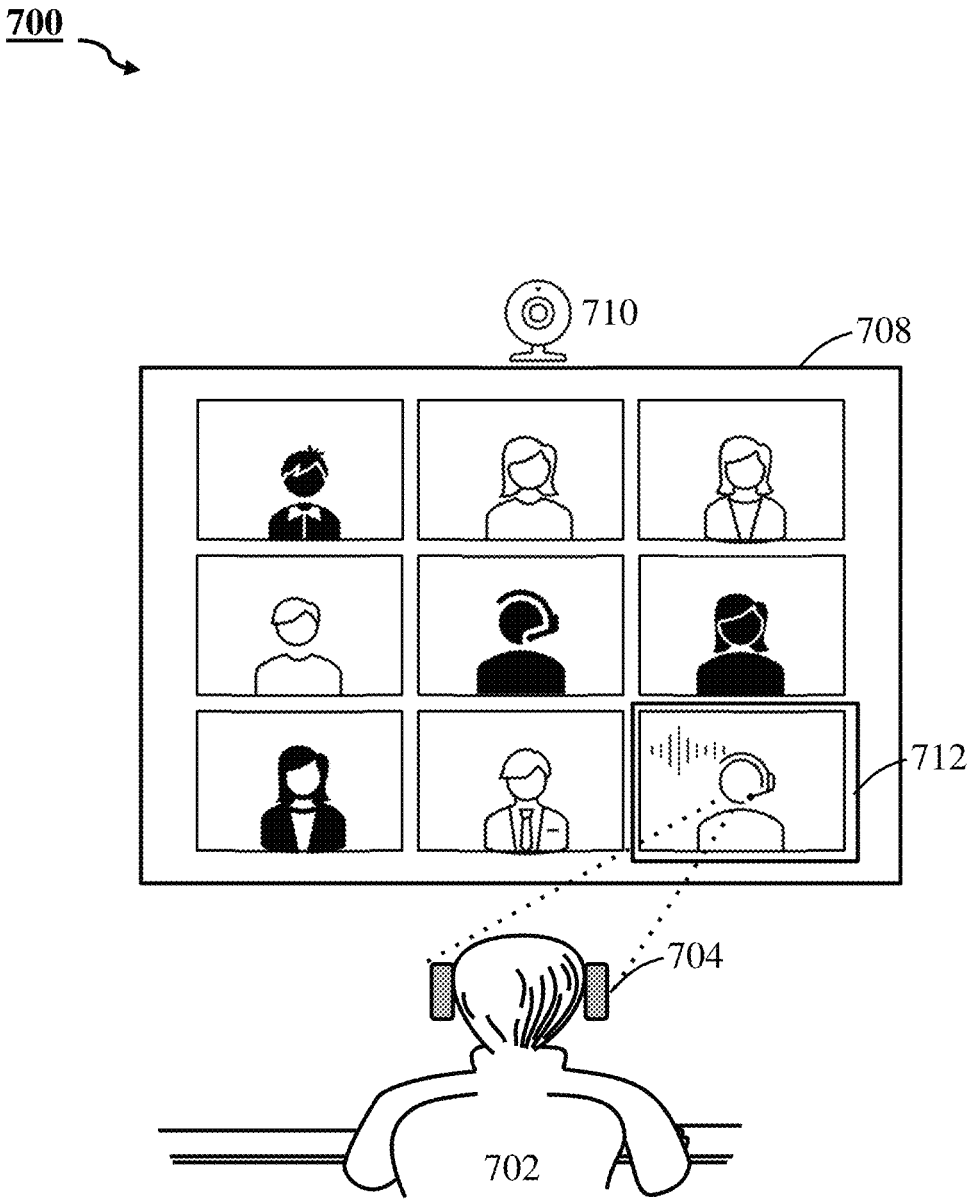
FIG. 7 shows another exemplary audio-visual field of a second user in the same multi-speaker virtual conference as shown in FIG. 6, according to one or more embodiments of the present subject matter.

FIG. 7 shows another exemplary audio-visual field 700 of a second user for the same multi-party virtual conference as shown in FIG. 6. In FIG. 7, via a different device, a second user 702 can attend the multi-speaker conference with first user 602 at the same time. According to some embodiments, second user 702 can listen to the audio playback with a pair of headphones 704 that can be ideal for reproducing spatialized binaural multi-channel audio signals.

As shown in FIG. 7, a computing device with a display 708 can show head images of the same attendees as FIG. 6. In this example, the same active speaker in FIG. 6 is shown at a different location, i.e., at the bottom right corner 712 on display 708. It can be the virtual audio source's location.

According to some embodiments, the system can also use one or more stereoscopic cameras 710 to capture the spatial data of second user 702's head/ear in relation to the display 708. According to some embodiments, the spatial data can comprise head and/or torso movement data of second user 702. For example, accelerometers and gyroscopes embedded in headphones 704 can continuously track the user's head movement and orientation.

According to some embodiments, the spatial data can comprise the approximate azimuth range of the bottom right corner 712 of the display, i.e., the active speaker's head image, in relation to the head/ear of second user 702. In addition, the elevation degree and distance between the virtual audio object and the user's head/ear can be received and/or estimated.

According to some embodiments, upon receiving the spatial data, spatial audio rendering system can generate second source locations between the virtual audio source's location and the second user's head/ear. As shown in FIG. 7, the bottom right corner 712 of the display in relation to second user 702's head can be categorized by a specific range of azimuth angles, e.g., 130°-160°, a range of elevation angles, e.g., 20°-35°, and an estimated distance, e.g., 2 ft-3 ft. In other words, whereas the active speaker appears at first user 602's left-top front side, it appears to locate at the second user 702's right-bottom front side at the same time.

According to some embodiments, a spatial audio rendering system can render the spatialized audio-visual fields for second user 702 based on the second source locations with auditory cues. The system can convolve the direct audio signal from the active speaker with auditory cues to generate a second source-specific multi-channel audio signal. A plurality of auditory cues, such as ITD, ILD, reverberation, HRTFs, can be incorporated into the multi-channel audio signal.

According to some embodiments, the system can determine a first delay of a left channel of the second multi-channel audio signal and a second delay of a right channel of the audio signal as the ITD cues. In this example, due to the slightly longer acoustic path to the user's left ear, the first delay of the left channel is larger than the second delay of the right channel. According to some embodiments, the system can compute a first loudness level for a left channel of the second multi-channel audio signal and a second loudness level of a right channel of the audio signal as the ILD cues. In this example, due to the closer acoustic path to the user's right ear, the second loudness level of the right channel is larger than that of the left channel.

According to some embodiments, reverberation or dissonance cues can be added to the second multi-channel audio signal based on the estimated distance. According to some embodiments, individualized HTRF cues can be added to the audio signals based on the second user 704's anatomy features such as ear canal shapes, head size, etc. Furthermore, HTRF cues can comprise other auditory cues, including ITD, ILD, reverberation cues.

When headphones 704 process the second multi-channel audio signal, the playback sound is intuitively rendered as coming from second user 702's bottom-right front side. In addition, the spatialized audio can be more intelligible due to the acoustic enhancement, e.g., the sound is louder and closer than the original sound.

As such, for the same active speaker as shown in FIG. 6 and FIG. 7, the spatial audio rendering system can generate independent and source-specific spatial audio scenes, each of which can be simultaneously tailored to a different user's measured virtual environments.

Figure 8:
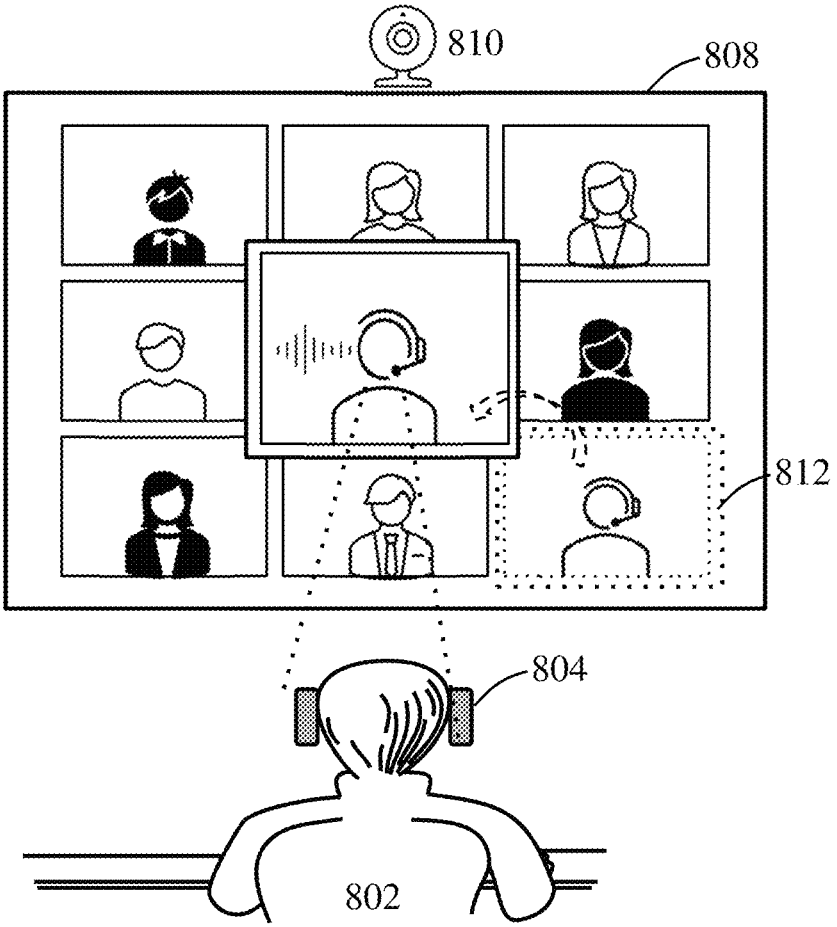
FIG. 8 shows an exemplary user modification of the spatial audio-visual field, according to one or more embodiments of the present subject matter.

FIG. 8 shows an exemplary user modification of the spatial audio-visual field. The spatial audio rendering can be interactive as user 802 can modify source locations through a user input. This can result in a dynamic adjustment of the simulated audio-visual fields. According to some embodiments, the spatial data can further comprise user's control of the spatial association. For example, a user input can be a location control request entered by the user. By clicking and dragging the speaker's head image, user 802 can move the active speaker 812 from the bottom-right corner of display 808 to a central location, resulting in a modification of the source locations. Similarly, user 802 can use voice queries to change the virtual location or size of the audio source.

According to some embodiments, the spatial audio rendering system can modify the rendering of the spatial audio in response to the location control request entered by the user. For example, after determining that the new location of the active speaker is directly opposite to user 802, e.g., azimuth angle near or at 90°, the system can reduce the delay for the left-channel signal of the multi-channel audio signal. In addition, the system can reduce or cancel the loudness difference between the left channel and right channel of the audio signal.

According to some embodiments, the user control can be tracked head/torso movement collected by various sensors/cameras. Accelerometers and gyroscopes embedded in headphone 804 can detect the user's head tilt, rotation, and other movement. In addition, stereoscopic camera 810 can detect user 802's head/torso movement. For example, when user 802 turns to face directly at the active speaker 812, the system can simulate the speaker's audio coming from a front position to the user. As such, the spatial audio rendering system is interactive as it can dynamically modify the rendering of the spatial audio in response to the user's active control or movement.

Figure 9:
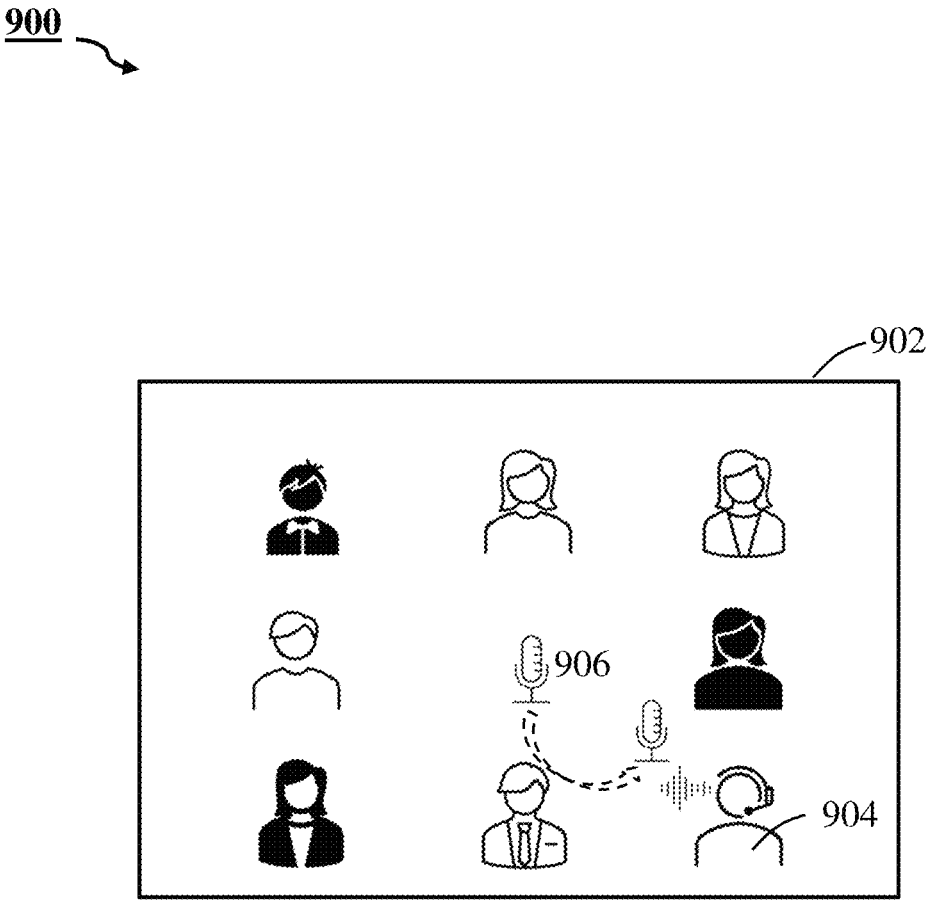
FIG. 9 shows an exemplary optional microphone feature of the spatial audio-visual rendering system, according to one or more embodiments of the present subject matter.

FIG. 9 shows an exemplary optional microphone feature of the spatial audio rendering system. FIG. 9 illustrates a meeting view 900 with a group of attendees gathering in a meeting room. The view can be broadcasted to a teleconference user via display 902. According to some embodiments, an implied location for microphone 906 can be at the center of the group. As a result, the audio signal captured from active speaker 904 can be rendered according to its distance to microphone 906. According to some embodiments, the system can enable an explicit microphone placement by the teleconference user. For example, the user can move microphone 906 closer to active speaker 904. As a result, the system can modify the audio processing from the speaker so that, based on distance cues, it becomes louder, clearer, and more intelligible.

Figure 10A:
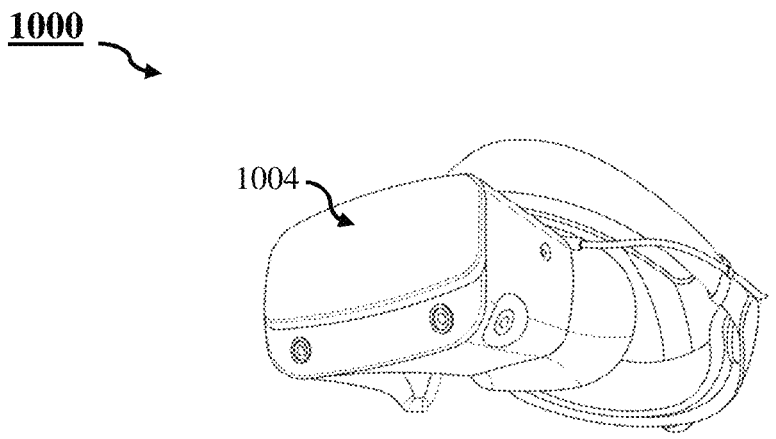
FIGS. 10A and 10B shows an example in which a head-mount AR device is configured to implement the spatialized audio-visual field, according to one or more embodiments of the present subject matter.
Figure 10B:
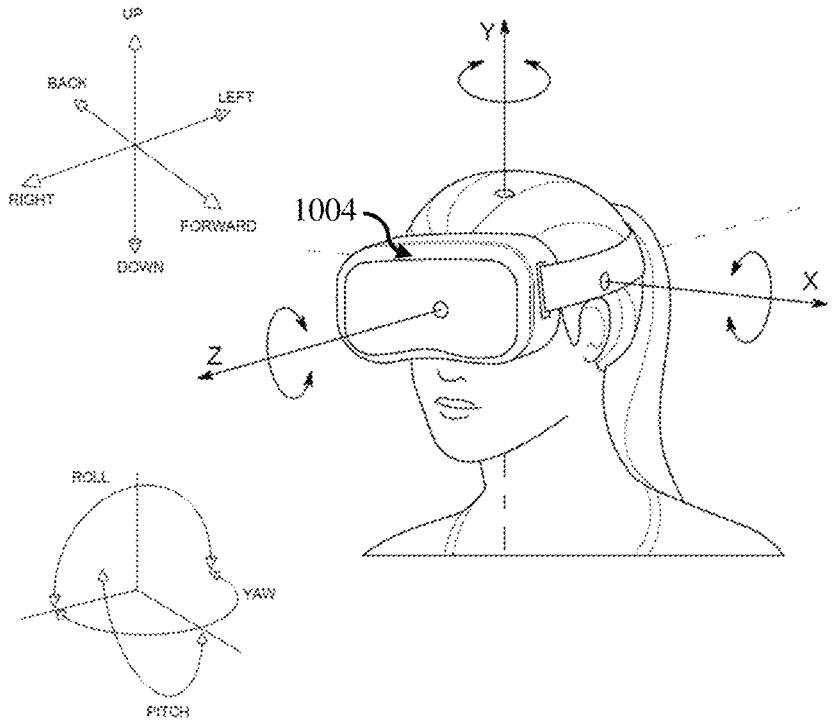

FIGS. 10A and 10B show an example 1000 in which a head-mount AR device is configured to implement the spatialized audio and video field. A head mount VR device 1004 can implement an VR application with spatialized audio scenes. FIG. 10A is a perspective view of a head mount VR device 1004 configured to implement the interactive and spatialized audio. To create immersive virtual experiences for a user, the head mount VR device 1004 can comprise an optical head-mounted display that can show corresponding videos in alignment with the audio scenes. Head mount VR device 1004 can comprise further microphones and/or speakers for enabling the speech-enabled interface of the device.

According to some embodiments, head mount VR device 1004 can comprise head motion or body movement tracking sensors such as gyroscopes, accelerometers, magnetometers, radar modules, LiDAR sensors, proximity sensors, etc. Additionally, the device can comprise eye-tracking sensors and cameras. As described herein, during the spatial audio rendering, these sensors can individually and collectively monitor and collect the user's physical state, such as the user's head movement, eye movement, body movement, to determine the audio simulation.

FIG. 10B is an exemplary view of a user using head mount VR device 1004 for the spatialized audio and video field. As shown in FIG. 10A, head mount VR device 1004 can measure motion and orientation in six degrees of freedom with sensors such as accelerometers and gyroscopes. As shown in FIG. 10B, according to some embodiments, the gyroscope can measure rotational data along the three-dimensional X-axis (pitch), Y-axis (yaw), and Z-axis (roll). According to some embodiments, the accelerometer can measure translational or motion data along the three-dimensional X-axis (forward-back), Y-axis (up-down), and Z-axis (right-left). The magnetometer can measure which direction the user is facing. As described herein, such movement data can be processed to determine, for example, the user's implied instruction to control an audio source location, the user's real-time viewpoint, and the dynamic rendering of the audio/video content, etc.

For example, in an online game setting, a user or his/her avatar can talk to another player's avatar via VR device 1004. When the movement sensors or the system determine that either one of the avatars walks away from the conversation, the spatial audio rendered by VR device 1004 can gradually become diminished and distant. Similarly, the user's auditory scenes can follow his movements in the game. This way, the VR device 1004 can render realistic and immersive experiences for the user.

Figure 11:
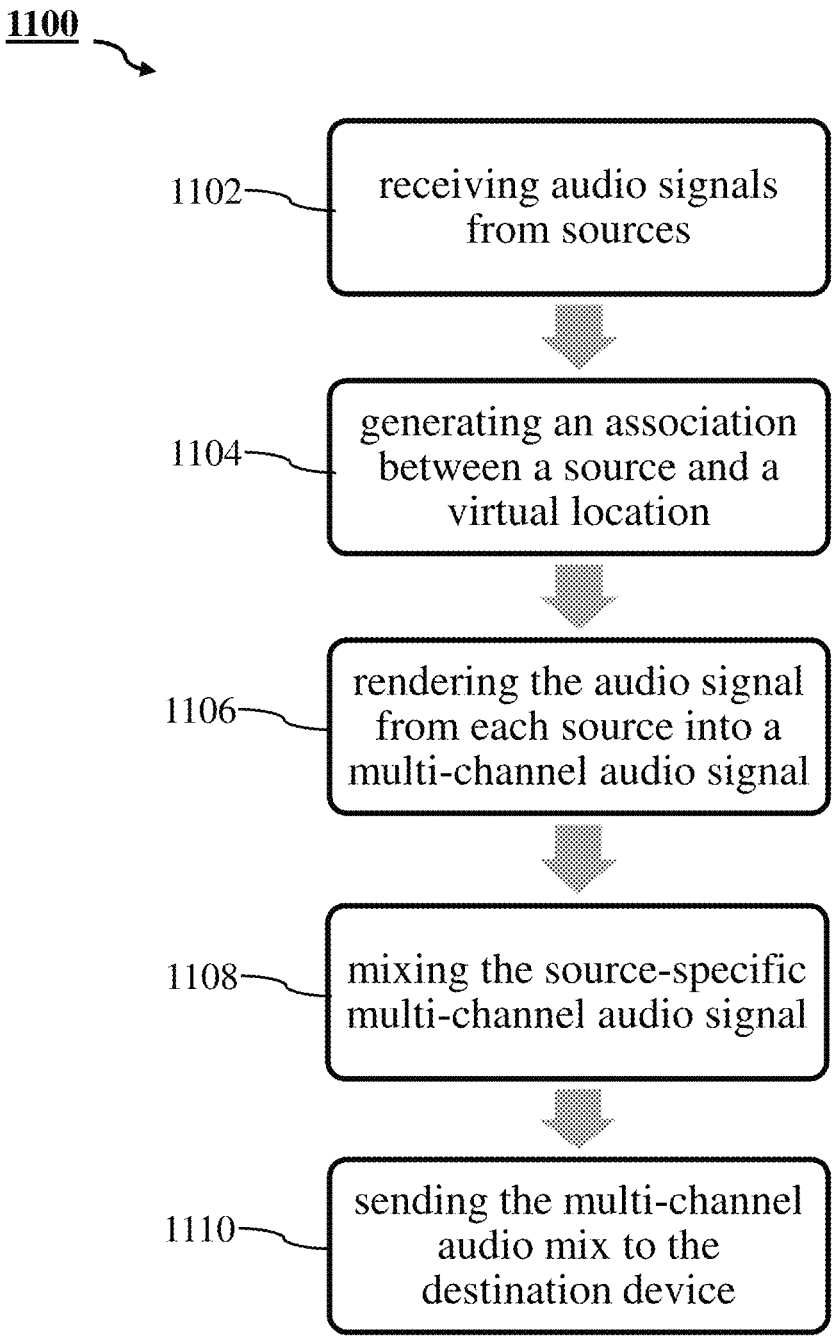
FIG. 11 shows an exemplary process of rendering spatialized audio-visual fields, according to one or more embodiments of the present subject matter.

FIG. 11 shows an exemplary process 1100 of rendering spatialized audio-visual fields. At step 1102, for each destination device of a plurality of destination devices, the spatial audio rendering system can receive a plurality of audio signals from a plurality of audio sources. The system can receive a number of signals from a group of audio data sources, e.g., from audio receivers associated with different speakers. One or more microphones can process respective audio sound waves and generate digital audio data for the system.

At step 1104, the system can generate, via a source placement model, an association between each source in the plurality of sources and a virtual location in the destination device's virtual space. According to some embodiments, for a destination device, a spatial audio rendering system can receive source locations indicating a virtual audio source's location within the destination device's virtual space. Among various methods, sensors can be configured to provide the relative spatial data, e.g., azimuth, elevation, distance, between a virtual audio source's location and the user's location.

According to some embodiments, spatial data can further comprise user input and/or head and/or torso movement data of a user associated with the destination. For example, accelerometers and gyroscopes embedded in headphones or an AR headset can continuously track the user's head movement and orientation.

Based on the spatial data, the spatial audio rendering system can generate the association between the virtual audio source's location within the destination device's virtual space. The association can comprise spatial parameters indicating the spatial relationship between the virtual audio source and the user's ears. For example, the association can comprise the source-ear acoustic path as well as the geometry information of the room.

At step 1106, the system can render the audio signal from each source, wherein the rendering takes the virtual location of the source in the destination device's virtual space as a parameter and maps the audio signal from the source to a source-specific multi-channel audio signal according to the parameter. According to some embodiments, the spatial audio rendering system can render the spatialized audio fields based on source locations via a spatializer. Furthermore, a spatializer can adopt various audio spatialization methods and generate various auditory cues, such as ITD, ILD, reverberation, HRTFs, to render the individualized spatial audio field for each user among a group of users. According to some embodiments, the spatializer can comprise one or more acoustic filters to convolve the original audio signal with the auditory cues. Furthermore, each audio signal from a source audio can be subject to a respective spatializer, which can generate individualized spatialization cues for each audio signal.

At step 1108, the system can mix the source-specific multi-channel audio signal from each source into a multi-channel audio mix for the destination device. According to some embodiments, a mixer can mix the source-specific multi-channel audio signal from each audio source into a multi-channel audio mix for a destination device.

At step 1110, the system can send the multi-channel audio mix to the destination device. According to some embodiments, a transmitter can send the multi-channel audio mix to the destination device with audio playback devices, e.g., headphones or loudspeakers, for rendering the spatialized audio field for a user, or each user in a group of users.

According to some embodiments, a user can receive the rendered spatial audio-visual fields via a destination device such as a personal computing device, a mobile device, a head-mount AR device. The destination device can have one or more embedded or external audio playback devices. According to some embodiments, the destination device can further comprise one or more embedded or external visual displays, which can deliver corresponding visual cues for the auditory scenes. As such, the user can experience immersive virtual scenes similar to his/her perception of real-world interactions.

According to some embodiments, multiple users can simultaneously receive individualized spatial audio-visual fields from the spatial audio rendering system, wherein the respective spatial audio-visual fields are different from each other. For example, a first audio source of speaker A can be associated by a first destination device with a first virtual location in the first destination device's virtual space. At the same time, the first audio source of speaker A can be associated by a second destination device with a second virtual location in the second destination device's virtual space. As the first virtual location differs from the second virtual location, the individualized spatial audio-visual fields for the first and the second destination device are different. Furthermore, different users of the first and the second destination device can independently modify the virtual association of speaker A in its respective virtual space.

Figure 12:
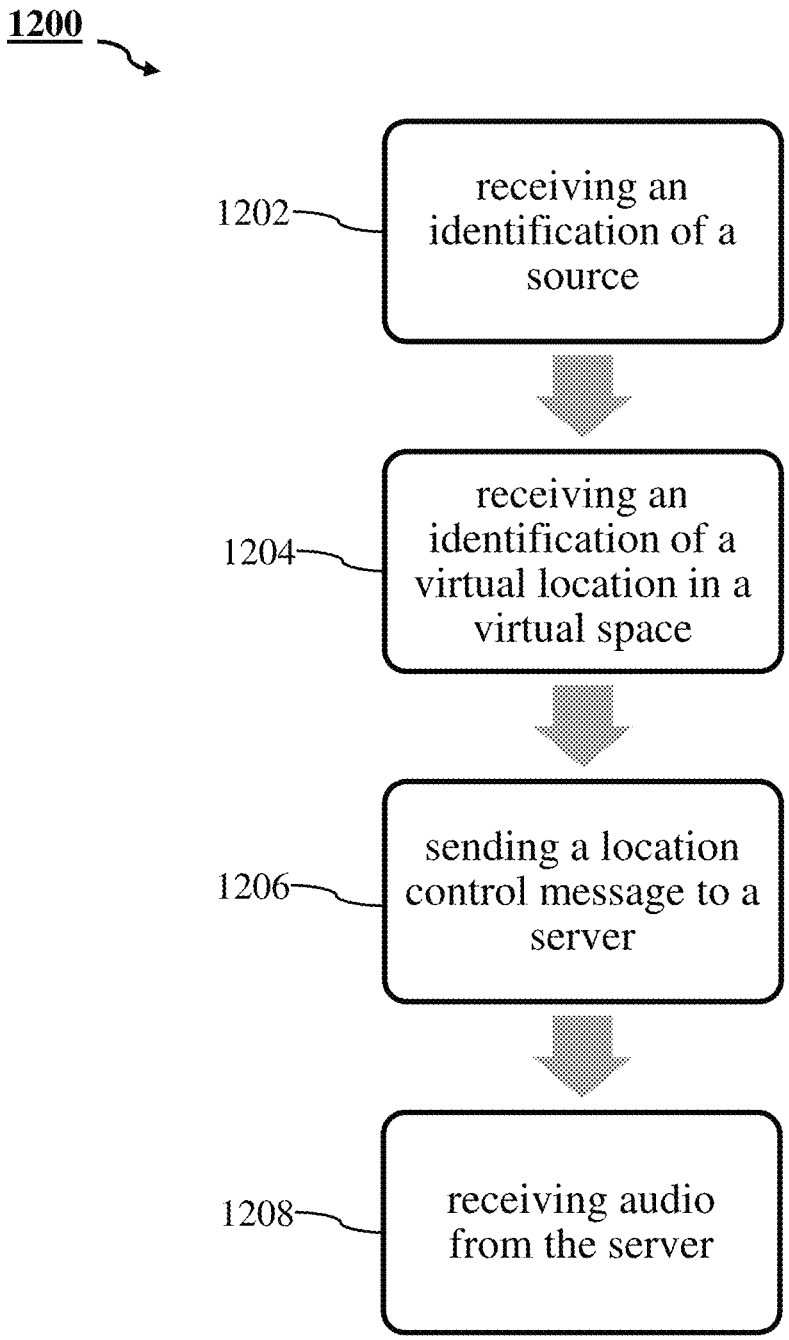
FIG. 12 shows another exemplary process of rendering spatialized audio-visual fields, according to one or more embodiments of the present subject matter.

FIG. 12 shows another exemplary process 1200 of rendering spatialized audio-visual fields for each destination of a plurality of destinations. At step 1202, a spatial audio rendering system can receive an identification of a source in a plurality of sources, each source being associated with an audio signal. According to some embodiments, the spatial audio rendering system can receive a number of audio signals from a number of source audios, e.g., source audio 1, source audio 2, and source audio 3, via audio receivers.

At step 1204, the system can receive an identification of a virtual location in a virtual space. According to some embodiments, for each audio signal, the system can generate source locations between a virtual audio source's location within a destination device's virtual space. Such source locations can based on spatial data indicating the virtual audio source's location within a destination device's virtual space. Spatial data can be based on a user's control or other methods. Various spatial capture or imaging sensors can be used to collect spatial data. For example, the spatial data can comprise the azimuth, elevation and/or distance between a virtual audio source's location and the user's head/ears.

At step 1206, the system can send a location control message to a server to request that the audio signal associated with the source be rendered in the virtual location in the virtual space. According to some embodiments, a user can modify an association via a user input, resulting in a dynamic adjustment of the simulated spatial audio-visual fields. According to some embodiments, a user input can be a location control request entered by the user. For example, the user can move the active speaker image from a first location to a second location on the display.

At step 1208, the system can receive audio from the server, the audio being rendered according to the identification of the virtual location. According to some embodiments, the spatial audio rendering system can modify the rendering of the spatial audio in response to the location control request entered by the user. For example, after determining that the new location of the active speaker image being directly opposite to the user, e.g., azimuth angle near or at 90°, the system can reduce the delay for the left-channel signal of the multi-channel audio signal. In addition, the system can reduce or cancel the loudness difference between the left channel and right channel of the audio signal.

Figure 13A:
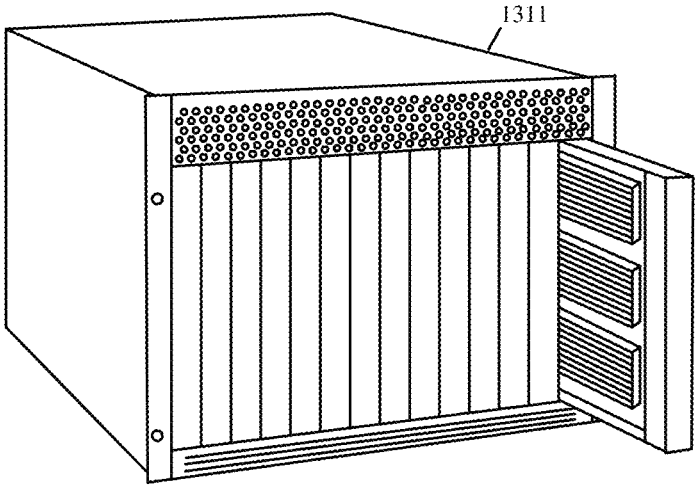
FIG. 13A shows a server system of rack-mounted blades, according to one or more embodiments of the present subject matter.

FIG. 13A shows a server system of rack-mounted blades for implementing the present subject matter. Various examples are implemented with cloud servers, such as ones implemented by data centers with rack-mounted server blades. FIG. 13A shows a rack-mounted server blade multiprocessor server system 1311. Server system 1311 comprises a multiplicity of network-connected computer processors that run software in parallel.

Figure 13B:
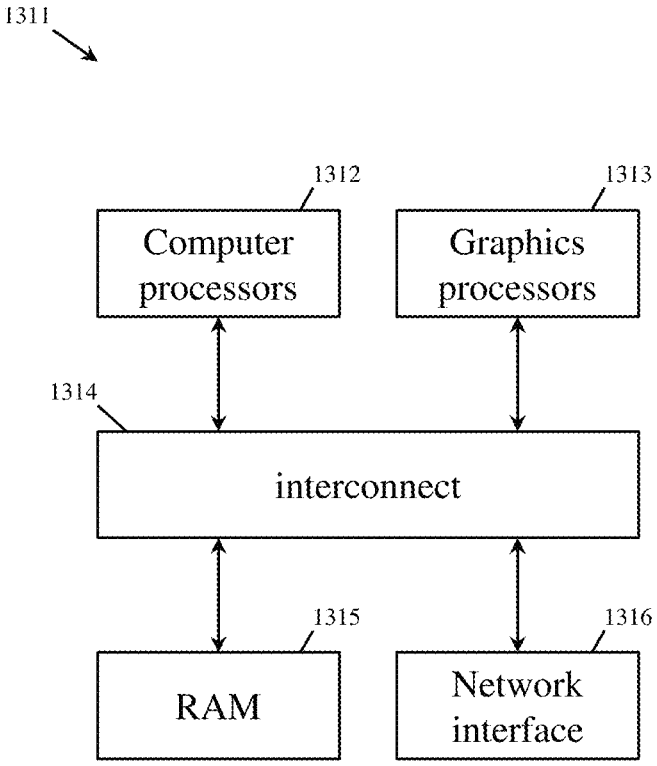
FIG. 13B shows a diagram of a networked data center server, according to one or more embodiments of the present subject matter.

FIG. 13B shows a diagram of a server system 1311. It comprises a multicore cluster of computer processors (CPU) 1312 and a multicore cluster of the graphics processors (GPU) 1313. The processors connect through a board-level interconnect 1314 to random-access memory (RAM) devices 1315 for program code and data storage. Server system 1311 also comprises a network interface 1316 to allow the processors to access the Internet, non-volatile storage, and input/output interfaces. By executing instructions stored in RAM devices 1315, the CPUs 1312 and GPUs 1313 perform steps of methods described herein.

Figure 14A:
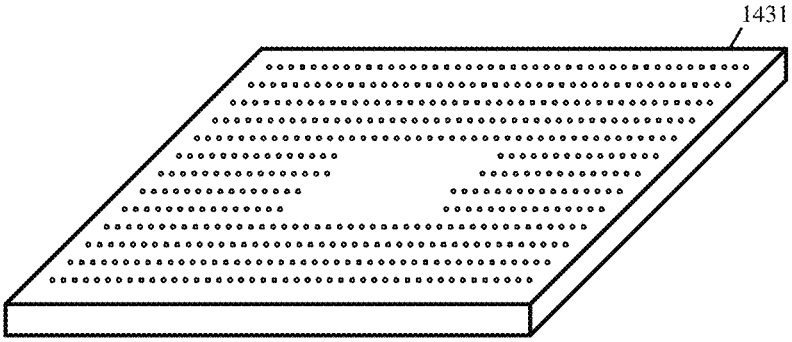
FIG. 14A shows a packaged system-on-chip device, according to one or more embodiments of the present subject matter.

FIG. 14A shows the bottom side of a packaged system-on-chip device 1431 with a ball grid array for surface-mount soldering to a printed circuit board. Various package shapes and sizes are possible for various chip implementations. System-on-chip (SoC) devices control many embedded systems, IoT device, mobile, portable, and wireless implementations.

Figure 14B:
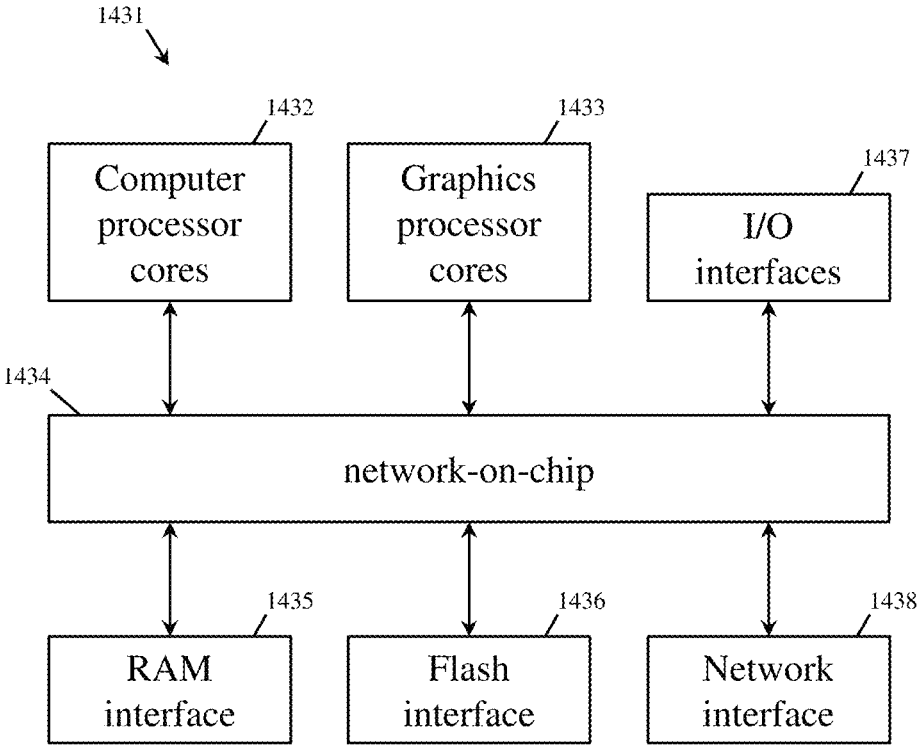
FIG. 14B shows a block diagram of a system-on-chip, according to one or more embodiments of the present subject matter.

FIG. 14B shows a block diagram of the system-on-chip 1431. It comprises a multicore cluster of computer processor (CPU) cores 1432 and a multicore cluster of graphics processor (GPU) cores 1433. The processors connect through a network-on-chip 1434 to an off-chip dynamic random access memory (DRAM) interface 1435 for volatile program and data storage and a Flash interface 1436 for non-volatile storage of computer program code in a Flash RAM non-transitory computer readable medium. SoC 1431 also has a display interface for displaying a graphical user interface (GUI) and an I/O interface module 1437 for connecting to various I/O interface devices, as needed for different peripheral devices. The I/O interface enables sensors such as touch screen sensors, geolocation receivers, microphones, speakers, Bluetooth peripherals, and USB devices, such as keyboards and mice, among others. SoC 1431 also comprises a network interface 1438 to allow the processors to access the Internet through wired or wireless connections such as WiFi, 3G, 4G long-term evolution (LTE), 5G, and other wireless interface standard radios as well as Ethernet connection hardware. By executing instructions stored in RAM devices through interface 1435 or Flash devices through interface 1436, the CPU cores 1432 and GPU cores 1433 perform functionality as described herein.

Examples shown and described use certain spoken languages. Various embodiments work, similarly, for other languages or combinations of languages. Examples shown and described use certain domains of knowledge and capabilities. Various systems work similarly for other domains or combinations of domains.

Some systems are screenless, such as an earpiece, which has no display screen. Some systems are stationary, such as a vending machine. Some systems are mobile, such as an automobile. Some systems are portable, such as a mobile phone. Some systems are for implanting in a human body. Some systems comprise manual interfaces such as keyboards or touchscreens.

Some systems function by running software on general-purpose programmable processors (CPUs) such as ones with ARM or x86 architectures. Some power-sensitive systems and some systems that require especially high performance, such as ones for neural network algorithms, use hardware optimizations. Some systems use dedicated hardware blocks burned into field-programmable gate arrays (FPGAs). Some systems use arrays of graphics processing units (GPUs). Some systems use application-specific-integrated circuits (ASICs) with customized logic to give higher performance.

Some physical machines described and claimed herein are programmable in many variables, combinations of which provide essentially an infinite variety of operating behaviors. Some systems herein are configured by software tools that offer many parameters, combinations of which support essentially an infinite variety of machine embodiments.

Several aspects of implementations and their applications are described. However, various implementations of the present subject matter provide numerous features including, complementing, supplementing, and/or replacing the features described above. In addition, the foregoing description, for purposes of explanation, used specific nomenclature to provide a thorough understanding of the embodiments of the invention. However, it will be apparent to one skilled in the art that the specific details are not required in order to practice the embodiments of the invention.

It is to be understood that even though numerous characteristics and advantages of various embodiments of the present invention have been set forth in the foregoing description, together with details of the structure and function of various embodiments of the invention, this disclosure is illustrative only. In some cases, certain subassemblies are only described in detail with one such embodiment. Nevertheless, it is recognized and intended that such subassemblies may be used in other embodiments of the invention. Practitioners skilled in the art will recognize many modifications and variations. Changes may be made in detail, especially matters of structure and management of parts within the principles of the embodiments of the present invention to the full extent indicated by the broad general meaning of the terms in which the appended claims are expressed.

Having disclosed exemplary embodiments and the best mode, modifications and variations may be made to the disclosed embodiments while remaining within the scope of the embodiments of the invention as defined by the following claims.

What is claimed is:

1. A computer-implemented method of rendering sources for telecommunication, the method comprising: for each destination device of a plurality of destination devices, each destination device having a virtual space:

receiving a plurality of audio signals from a plurality of sources associated with a plurality of network devices;

generating an association between each source in the plurality of sources and a virtual location in the destination device's virtual space;

rendering the audio signal from each source, wherein the rendering takes the virtual location of the source in the destination device's virtual space as a parameter and maps the audio signal from the source to a source-specific multi-channel audio signal according to the parameter;

mixing the source-specific multi-channel audio signal from each source into a multi-channel audio mix for the destination device; and sending the multi-channel audio mix to the destination device.

2. The computer-implemented method of claim 1, wherein a first source from the plurality of sources is associated with a first virtual location in a first destination device's virtual space; and wherein the first source from the plurality of sources is associated with a second virtual location in a second destination device's virtual space, and the first virtual location differs from the second virtual location.

3. The computer-implemented method of claim 1, further comprising a first destination device with a user interface, wherein the user interface allows a user to select a first source in the plurality of sources and a first virtual location in a first destination device's virtual space to express a location control indication;

wherein the first destination device sends a location control request to a processor indicating the first source in the plurality of sources and the first virtual location in the device's virtual space; and wherein the processor modifies the association of the virtual location of the first source for the first destination device according to the location control indication.

4. The computer-implemented method of claim 1, further comprising:

receiving location data of each source in the destination device's virtual space from one or more sensors.

5. The computer-implemented method of claim 1, wherein the rendering to a source-specific multi-channel audio signal includes one or more auditory cues regarding the location of the source in the destination device's virtual space.

6. The computer-implemented method of claim 1, further comprising:

computing a first delay for a first channel of the source-specific multi-channel audio signal according to the virtual location of the source; and computing a second delay for a second channel the source-specific multi-channel audio signal according to the virtual location of the source.

7. The computer-implemented method of claim 1, further comprising:

computing a first loudness for a first channel of the source-specific multi-channel audio signal according to the virtual location of the source; and computing a second loudness for a second channel of the source-specific multi-channel audio signal according to the virtual location of the source.

8. The computer-implemented method of claim 1, further comprising creating a distance cue by:

computing a first reverb signal of the source; and computing a mix of the first reverb signal of the source and a direct signal of the source according to the virtual location of the source.

9. The computer-implemented method of claim 1, further comprising:

receiving a user's control over the virtual location of the source in the destination device's virtual space; and adjusting the rendering of the source based on the user's control.

10. The computer-implemented method of claim 1, further comprising:

receiving a change signal for the association between each source in the plurality of sources and the virtual location in the destination device's virtual space; and adjusting the rendering of the source based on the change signal.

11. The computer-implemented method of claim 1, further comprising:

generating one or more visual cues in association with the source location, the one or more visual cues being consistent with one or more auditory cues.

12. A computer-implemented method of rendering a source for each destination of a plurality of destinations for telecommunication, each destination having a virtual space, the method comprising:

receiving a first input audio signal from the source associated with a network device;

generating an association between the source and a virtual location in the destination's virtual space, the virtual location differing from the virtual location of the same source in the space of a different destination;

rendering the first input audio signal from the source according to the virtual location of the source in the destination's virtual space to produce a first multi-channel audio signal; and sending an output signal comprising the first multi-channel audio signal to the destination.

13. The computer-implemented method of claim 12, further comprising:

computing a first delay for a first channel of the first multi-channel audio signal according to the virtual location of the source; and computing a second delay for a second channel of the first multi-channel audio signal according to the virtual location of the source.

14. The computer-implemented method of claim 12, further comprising:

computing a first loudness for a first channel of the first multi-channel audio signal according to the virtual location of the source; and computing a second loudness for a second channel of the first multi-channel audio signal according to the virtual location of the source.

15. The computer-implemented method of claim 12, further comprising creating a distance cue by:

computing a first reverb signal of the source; and computing a mix of the first reverb signal of the source and a direct signal of the source according to the virtual location of the source.

16. The computer-implemented method of claim 12, further comprising creating a three-dimensional cue by:

computing a first Head-Related Transfer Function for a first channel of the first multi-channel audio signal according to the virtual location of the source; and computing a second Head-Related Transfer Function for a second channel of the first multi-channel audio signal according to the virtual location of the source.

17. The computer-implemented method of claim 12, further comprising:

receiving a second input audio signal from a second source;

generating an association between the second source and a second virtual location in the destination's virtual space;

rendering the second input audio signal from the second source according to the second virtual location of the second source in the destination's virtual space to produce a second multi-channel audio signal; and mixing the first multi-channel audio signal and the second multi-channel audio signal to create the output signal.

18. The computer-implemented method of claim 12, further comprising:

receiving a user's control for the association between the source and the virtual location in the destination's virtual space.

19. The computer-implemented method of claim 18, further comprising:

receiving a change signal; and changing the association according to the change signal.

20. A computer-implemented method for telecommunication, comprising:

receiving an identification of a source in a plurality of sources associated with a plurality of network devices, each source being associated with an audio signal from a network device;

receiving an identification of a virtual location in a virtual space;

sending a location control message to a server to request that the audio signal associated with the source be rendered in the virtual location in the virtual space; and receiving audio from the server, the audio being rendered according to the identification of the virtual location.

21. The computer-implemented method of claim 20, wherein the virtual location is based on spatial data indicating a virtual audio source's location within a destination device's virtual space.

22. The computer-implemented method of claim 20, wherein the location control message comprises spatial data collected by one or more sensors.

* * * * *